US007836936B2

(12) United States Patent
Graichen

(10) Patent No.: US 7,836,936 B2
(45) **Date of Patent: *Nov. 23, 2010**

(54) FRAYLESS FRANGIBLE CONNECTION FOR FABRIC AND VERTICAL BLIND SYSTEM INCORPORATING THE SAME

(75) Inventor: Claus Graichen, Henderson, NC (US)

(73) Assignee: Lace Lastics Co., Inc., Oxford, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/099,921

(22) Filed: Apr. 6, 2005

(65) Prior Publication Data

US 2005/0257898 A1 Nov. 24, 2005

Related U.S. Application Data

(63) Continuation-in-part of application No. 10/960,533, filed on Oct. 7, 2004, now Pat. No. 7,730,927.

(60) Provisional application No. 60/562,333, filed on Apr. 14, 2004.

(51) Int. Cl.
*E06B 3/48* (2006.01)

(52) U.S. Cl. ..... 160/89; 160/84.04; 160/179; 160/236; 160/330; 160/178.1 V

(58) Field of Classification Search ..... 160/89, 160/84.04, 84.05, 168.1 R, 179, 330
See application file for complete search history.

(56) References Cited

U.S. PATENT DOCUMENTS

| | | | | |
|---|---|---|---|---|
| 3,851,699 | A | 12/1974 | Shapiro | |
| 3,946,789 | A * | 3/1976 | Ronkholz-Tolle, nee Tolle | 160/168.1 R |
| 5,715,883 | A * | 2/1998 | Keith | 160/89 |
| 6,510,885 | B1 * | 1/2003 | Shih | 160/89 |
| 2003/0019589 | A1 * | 1/2003 | Colson et al. | 160/84.06 |
| 2003/0084981 | A1 | 5/2003 | Swiszcz | |
| 2005/0211392 | A1 * | 9/2005 | Elembaby | 160/89 |
| 2006/0237147 | A1 * | 10/2006 | Strand et al. | 160/89 |

FOREIGN PATENT DOCUMENTS

| | | | |
|---|---|---|---|
| CA | 2090046 | A1 | 8/1994 |
| DE | 20219236 | U1 | 3/2003 |

OTHER PUBLICATIONS

Supplementary European Search Report, dated Mar. 11, 2009.

* cited by examiner

*Primary Examiner*—Blair M. Johnson
(74) *Attorney, Agent, or Firm*—Amster, Rothstein & Ebenstein LLP

(57) ABSTRACT

A vertical blind panel including a plurality of substantially opaque louvers and a plurality of sheer transparent or translucent spacers. Each of the plurality of spacers is disposed between a respective pair of the plurality of louvers. At least one of the plurality of louvers includes a first vertically oriented louver portion connected to a second vertically oriented louver portion.

14 Claims, 27 Drawing Sheets

FRAYLESS FRANGIBLE CONNECTION FOR FABRIC AND VERTICAL BLIND SYSTEM INCORPORATING THE SAME

RELATED APPLICATIONS

This application is a continuation-in-part of U.S. patent application Ser. No. 10/960,533, filed Oct. 7, 2004, now U.S. Pat. No. 7,730,927 the contents of which are incorporated herein by reference in their entirety, and which claims priority to U.S. Provisional Patent Application Ser. No. 60/562,333, filed Apr. 14, 2004.

FIELD OF THE INVENTION

The present invention relates to a frangible connection knitted into a fabric panel during manufacture. More specifically, the present invention relates to a vertical blind system having decorative louvers which are knitted in a single panel and attached together by a knitted frangible hinge or tear away fringe.

BACKGROUND OF THE INVENTION

When knitting a large fabric panel, it is often the case that the finished fabric will be cut into smaller pieces for use in a finished product, such as a window treatment. The cutting of fabric, however, introduces a number of problems which may present themselves during manufacture, most notably that extra steps are required to cut the fabric accurately. Likewise, by its very nature, cutting interrupts the fabric matrix, leaving a frayed edge which can undermine the strength or appearance of the fabric in the finished product.

In many window or see-through door applications, it is desirable to control the amount of light admitted through the window or see-through door. For instance on sunny days in warm climates, the sun is too strong (and too hot) for the comfort of the occupants, as well as being damaging to interior furnishings that may fade or become brittle. Typically, blinds are fitted, consisting of multiple slats of opaque material that can be individually rotated, in a coordinated manner, to block all or part of the light. When such slats are arrayed horizontally, the assembly is commonly called a "venetian blind".

In large windows or doors, venetian blinds are impractical because they can become difficult to raise completely when needed for unobstructed viewing, or to clean the glass behind. So, often a variant called a "vertical blind" is fitted, in which rotatable slats are hung vertically from their ends on a traverse mechanism with individual, coordinated rotating hangers. Vertical blinds have been most often used in settings where large windows are more common, such as in commercial buildings or for residential patio doors or picture windows.

Vertical blinds are well known and commonly comprise elongated strips or slats of opaque material suspended vertically from an overhead traverse mechanism provided with individual rotatable hangers. Conventional louvers, also called slats or vanes, of a vertical blind are adapted for lateral movement between a drawn blind position, in which the blind is opened to one or opposite ends of a traverse or channel adjacent their tops and an extended blind position wherein the louvers are positioned in generally equal spaced relation to one another along the length of the traverse or channel.

The louvers themselves are also adapted for selective rotation about their longitudinal axes between open and closed positions. The spacing between the louvers when the blind is extended is approximately equal to their width. Thus, when the traverse mechanism is positioned, for example, above and along the horizontal length of a window, the rotation of the louvers selectively blocks the passage of light through the window.

The vertical louvers may be made of vinyl or other suitable material, colored to add an accent color to the room or colored to blend with the primary color of the room. These louvers are generally limited to solid colors, or simple vertical patterns, because they are manufactured separately. If a continuous horizontal pattern effect is attempted using this method, it is prohibitively difficult accurately to align sequential louvers horizontally. Each louver in a horizontal pattern represents an individual pattern segment even slight misalignment of which would be unattractively obvious and would destroy the aesthetic appeal of the blind.

The louvers may also be made or covered with a fabric material to achieve a specific design effect. Louvers formed entirely of fabric may lack the rigidity of solid louvers, and thus may be provided with a hanger reinforcement at the top and a weight on the bottom to permit the louvers to hang uniformly.

Currently, fabric blind louvers are manufactured from continuous rolls of louver-width fabric that have been slit from wider fabric rolls. These are individually cut to length and sewn to form a louver. This production method makes the incorporation of a horizontal pattern prohibitively difficult because there is no way to assure that pattern elements will align horizontally. Even if the louvers were cut transversely from rolls of patterned fabric having a width equal to the length of the louver, further processing such as the attachment of mounting hardware to each of the louvers would introduce sufficient vertical error into each louver to destroy the horizontal alignment of the pattern.

Fabric louvers manufactured from a single roll of fabric have an additional drawback in the tendency of the louvers to fray along their longitudinal edges, particularly as a result of machine washing. Because the material from which the louvers are cut necessarily has an existing continuous structure, the cutting of which necessarily presents edges where the structure has been interrupted, resulting in a series of loose threads. Untreated, these threads tend to unravel, weakening the fabric and creating an unattractive frayed edge over time and as laundered. Preventing this result requires additional costly manufacturing steps.

It is also known to combine a vertical blind with a sheer fabric wherein the opaque vertical slats of the blind cooperate with the sheer fabric to provide diffusion of the light entering between the opaque slats when the blind has been extended and is in the open position. This provides an aesthetically pleasing effect, as well as adding privacy as a result of reduction in the clarity of view from the exterior into the interior of the building.

U.S. Pat. No. 5,638,880 to Colson et al. discloses such a combination vertical blind wherein rigid opaque vanes having the arrangement of a conventional vertical blind are attached at one of their longitudinal edges to a sheet of sheer fabric such that light passing between the slats of the blind passes through the sheer fabric when the blind is open. Such a blind can be expensive to manufacture, as the sheer fabric must be attached to the vanes during an additional manufacturing step because the vanes are made of a different material from the fabric. Furthermore, although the width of a conventional vertical blind can be adjusted by adding or removing a number of discreet vanes, this is not possible in a combination blind because the vanes are essentially connected together into a single structure by the sheer fabric, requiring these blinds to be custom made to a specific width, also adding to their expense.

Another example of a combination blind is disclosed in U.S. Pat. No. 3,851,669 to Shapiro. Shapiro is directed to a drape adapted to be supported in the manner of a vertical blind and having alternate opaque and sheer vertical sections. The opaque sections are generally rigid and may be selectively rotated to permit the transmission of light through the sheer sections or to block the transmission of light by folding the sheer sections over the opaque sections. One obvious drawback, in addition to the drawbacks discussed with respect to Colson et al. above, is that the rigid vanes overlap the fabric requiring excessive fabric in order to fabricate the entire window covering. Further, the vanes or louvers are only attached to the fabric material along a top and bottom edge thereof, thereby inhibiting the control over the fabric material during operation of the window covering.

Another embodiment disclosed by Shapiro is a blind having alternating opaque and sheer sections in which the generally rigid vertically extending louvers are eliminated and substituted by a fabric panel having alternate vertical sections of fine and coarse mesh. The fine mesh sections may be provided with stiffening members at a top hem thereof and are connected to a vertical blind traverse from which the fine mesh sections may be rotated as louvers. When in the open position, the coarse mesh sections are disposed so as to admit a maximum of light therethrough. When in the closed position, the fine mesh sections are rotated so that the edges thereof overlap adjacent fine mesh sections to impede the transmission of light. Although this embodiment overcomes some of the limitations of the first Shapiro embodiment, a disadvantage of such a blind would be due to the lack of stiffness of the fine mesh "louver" sections. Any attempt to rotate the louvers of the second Shapiro embodiment would be resisted progressively along the length of the louver, resulting in an unattractive, non-uniform twisting which would render the blind nonfunctional.

Therefore a need exists for a vertical blind which can display a pattern horizontally across its louvers such that the alignment of the pattern from one louver to the next occurs without noticeable misalignment.

A further need exists for a vertical blind having louvers formed entirely of fabric, said louvers having an independent knitted structure wherein the major seams are substantially uninterrupted and free of loose thread ends, and wherein said louvers can be machine washed without developing frayed seams.

A still further need exists for a combination blind comprising a panel of fabric combining sheer and light-blocking sections, said blinds having sections of sufficient rigidity to function as louvers and a structure which allows the louvers to uniformly adjust to vary the amount of light which passes through the sheer sections of the blind, without the need for stiff louver panels.

A still further need exists for a fabric combination blind which can be produced in a standard width which can be adjusted easily as needed during installation over non-standard windows.

SUMMARY OF THE INVENTION

The invention seeks to resolve these problems and satisfy these needs by proposing a frayless frangible connection which permits the knitting of multiple components of a vertical blind from a single fabric panel.

A vertical blind panel according to an exemplary embodiment of the present invention includes a plurality of substantially opaque louvers, and a plurality of sheer transparent or translucent spacers. Each of the plurality of spacers is disposed between a respective pair of the plurality of louvers. At least one of the plurality of louvers includes a first vertically oriented louver portion connected to a second vertically oriented louver portion.

A vertical blind assembly according to an exemplary embodiment of the invention includes at least one vertical blind panel including a plurality of substantially opaque louvers, and a plurality of sheer transparent or translucent spacers. Each of the plurality of spacers is disposed between a respective pair of the plurality of louvers. At least one of the plurality of louvers includes a first vertically oriented louver portion connected to a second vertically oriented louver portion, the first louver portion being folded over the second louver portion.

In at least one embodiment, the first louver portion is connected to the second louver portion by a hinge, which allows the first and second louver portions to fold relative to one another.

In at least one embodiment, the hinge includes a vertical pillar stitch and connector yarns that attach the first and second louver portions to the pillar stitch.

In at least one embodiment, the vertical edges of the louvers and spacers are cut from a material web by horizontally cutting the material web using an ultrasonic cutting device.

In at least one embodiment, a hanger reinforcement member is formed at an upper edge portion of each of the louvers.

In at least one embodiment, the hanger reinforcement member is attached to a respective louver by at least one of ultrasonic welding and adhesive.

In at least one embodiment, a hole is formed in the hanger reinforcement member through which a vertical blind hanger hook may pass.

In at least one embodiment, the plurality of louvers includes a first edge louver that forms a first horizontal edge of the vertical blind panel and a second edge louver that forms a second horizontal edge of the vertical blind panel, and only the louvers between the first and second edge louvers include first and second louver portions.

In at least one embodiment, the at least one vertical blind panel includes a plurality of vertical blind panels, and each vertical blind panel is connected to an adjacent vertical blind panel by passing a hanger hook through adjacent first and second edge louvers.

A method of forming vertical blind panels according to an exemplary embodiment of the invention includes forming a continuous web of vertical blind panels. Each of the vertical blind panels includes a plurality of substantially opaque louvers and a plurality of sheer transparent or translucent spacers. Each of the plurality of spacers is disposed between a respective pair of the plurality of louvers. At least one of the plurality of louvers includes a first vertically oriented louver portion connected to a second vertically oriented louver portion. The continuous web of vertical blind panels is cut to form separate vertical blind panels.

In at least one embodiment, the cutting step includes cutting the continuous web of vertical blind panel horizontally using an ultrasonic cutter.

In at least one embodiment, the first louver portion is connected to the second louver portion by a hinge, which allows the first and second louver portions to fold relative to one another.

In at least one embodiment, the method further includes a step of attaching a hanger reinforcement member at an upper edge portion of each of the louvers.

In at least one embodiment, the hanger reinforcement member is attached to a respective louver by at least one of ultrasonic welding and adhesive.

In at least one embodiment, the plurality of louvers include a first edge louver that forms a first horizontal edge of the vertical blind panel and a second edge louver that forms a second horizontal edge of the vertical blind panel, and only the louvers between the first and second edge louvers comprise first and second louver portions.

Other aspects, features, and details of the present invention can be more completely understood by reference to the following detailed description of the preferred embodiments, taken in conjunction with the drawings, and from the appended claims.

DESCRIPTION OF THE PREFERRED EMBODIMENTS

Figure 1:
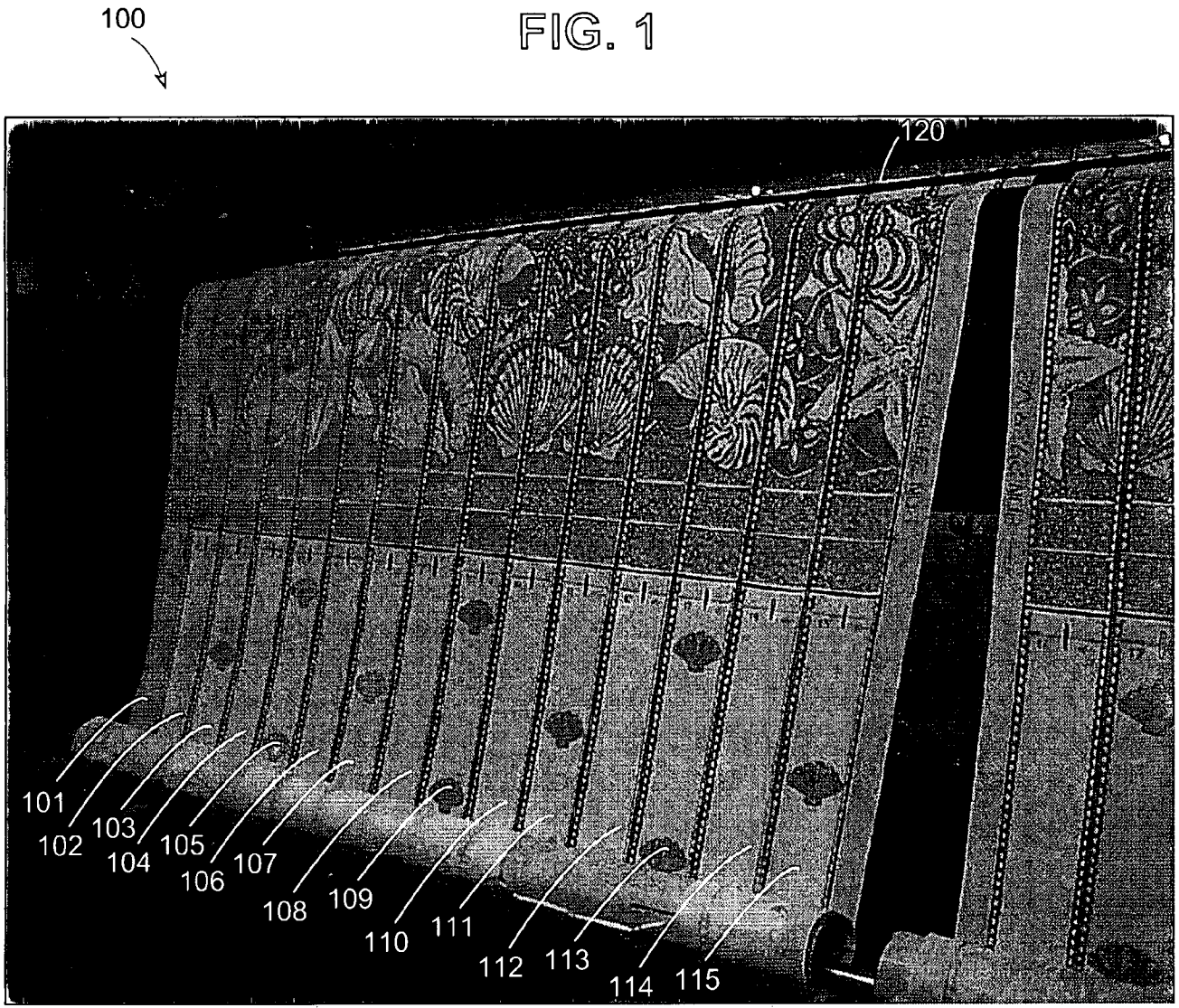
FIG. 1 is a front perspective view of an embodiment of a vertical blind incorporating the present invention, partially rolled around a tube.

An arrangement of a first embodiment of a vertical blind incorporating the present invention is shown in FIG. 1. FIG. 1 illustrates a single fabric panel 100 comprising fifteen louvers of a vertical blind 101-115. This window treatment has a pattern 120 that spans the width of the panel. As illustrated, the design continues from one louver to the next. The individual louvers for this window treatment have been knit in a single panel to be separated after they are finished, as described below, assuring an accurate alignment of the pattern when installed. Each of louvers 101-115 are separated by a tear away fringe, which enables the louvers to be separated for installation.

Figure 2:
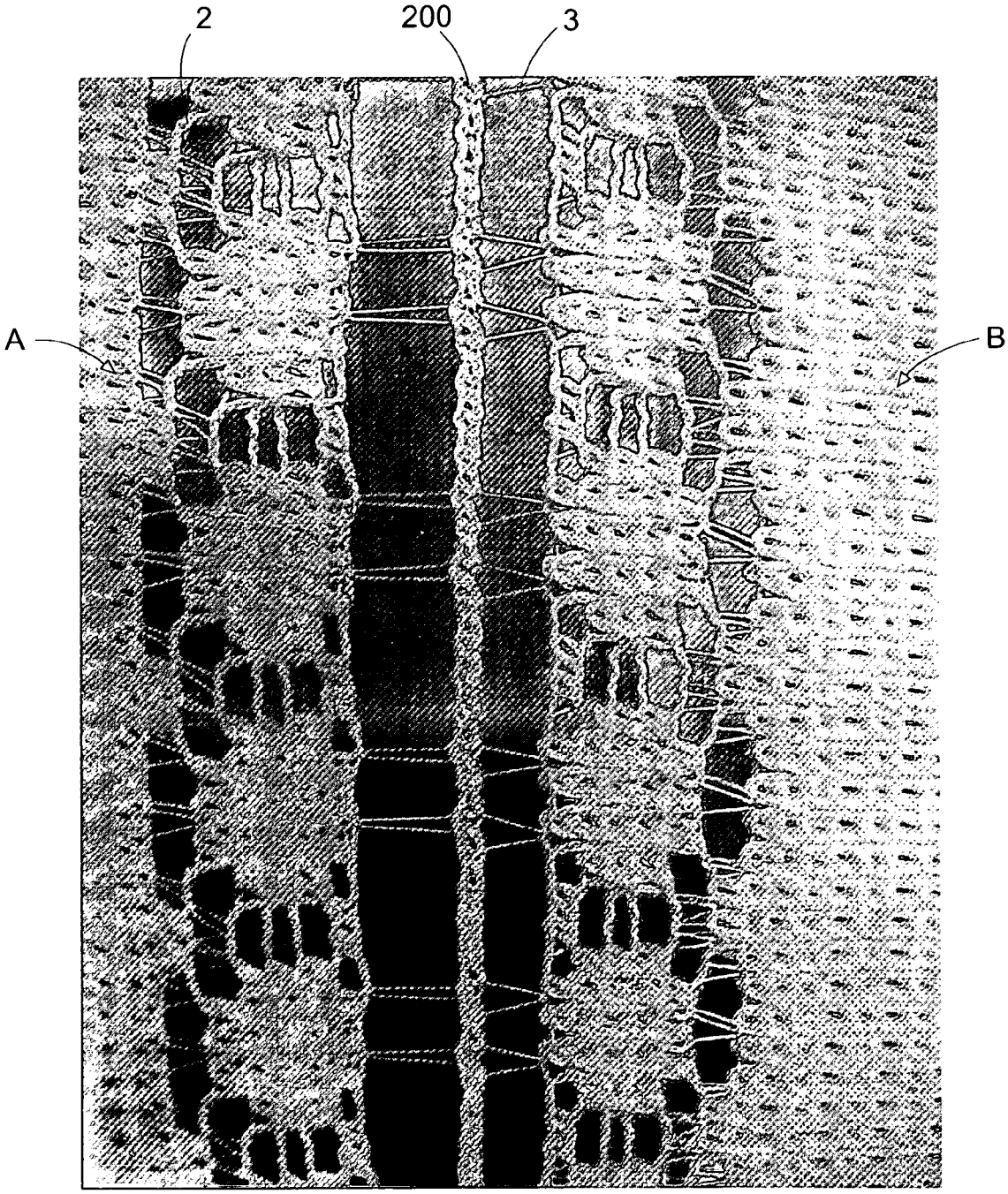
FIG. 2 is a plan view of the construction details of the tear-away fringe of the present invention.

FIG. 2 is a detail of the tear away fringe 200 of the present invention. The tear away fringe 200 is shown running vertically between two adjacent louvers A and B. Connector yarns 2 and 3 are shown connecting tear away fringe 200 to the edge of louvers A and B respectively. Prior to installation of the louvers, tear away fringe 200 is pulled away to separate louvers A and B. Connector threads 2 and 3 attaching louvers A and B to fringe 200 will pull away with the fringe leaving a clean edge as described below with respect to FIG. 3.

Figure 3:
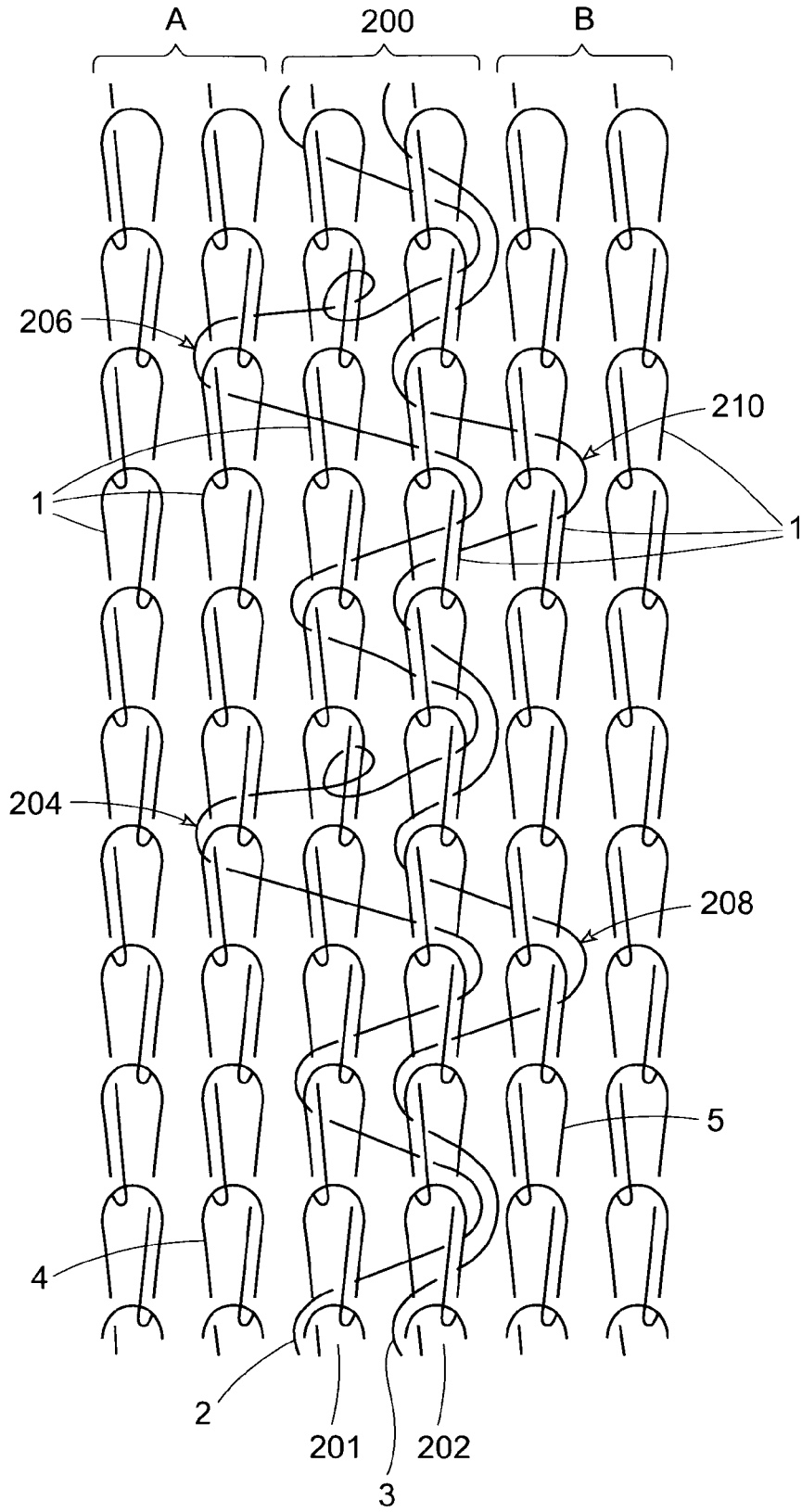
FIG. 3 is a schematic representation of the tear-away fringe of the present invention.

FIG. 3 is a schematic representation of the tear-away fringe of FIG. 2. pillar stitches 1 run vertically through the fabric, parallel to each other for the width of the entire panel. For example, in the panel of FIG. 1, the vertically extending pillars would continue to the left and right of panel 120 across the entire width of the panel. Preferably, pillar stitches 1 are formed of a high tenacity polyester yarn. Pillar stitches 1 form the basis of the structure of the fabric of panel 120. In the preferred embodiment, pillars 1 are the stitches to which all other yarns attach to form a fabric. As shown, pillar stitches 4 and 5 represent the edge stitch of louvers A and B respectively, pillar stitch 4 being the right most edge of louver A and pillar stitch 5 being the left most edge of louver B. As noted above, FIG. 3 illustrates only two pillar stitches of each louver, although in a preferred embodiment, a louver is formed for example of 30 or more pillar stitches.

Tear-away fringe 200, by contrast, is formed of 2 pillar stitches 201 and 202, said pillar stitches preferably being identical in structure to the pillar stitches that comprise louvers A and B. Connector yarns 2 and 3 are shown respectively linking pillars 4 and 5 to tear-away fringe 200. Connector yarns 2 and 3 continue in a generally vertical direction through tear-away fringe 200, and in a set pattern traverse between tear-away fringe 200 and pillar stitches 4 and 5.

Specifically, as shown in FIG. 3, connector yarn 2 traverses between pillar stitches 201 and 202 and traverses between tear away fringe 200 and pillar stitch 4 at locations 204 and 206. Similarly, connector yarn 3 traverses between tear away fringe 200 and pillar stitch 5 at locations 208 and 210. By contrast to connector yarn 2, however, connector yarn 3 does not traverse both pillars 201 and 202 of tear away fringe 200, but rather traverses only between pillar stitches 202 and 5. It is not critical that one or more of connector yarns 2 and 3 traverse between pillar stitches 201 and 202, however, the connector yarns 2 and 3 must traverse respectively at least one of the pillar stitches of louvers A and B, preferably the edge pillar stitches thereof, as the connector yarns 2 and 3 are the only connection between louvers A and B and tear-away fringe 200. Hence, connector yarns 2 and 3 are the only connection with attaches louvers A and B together.

Figure 4:
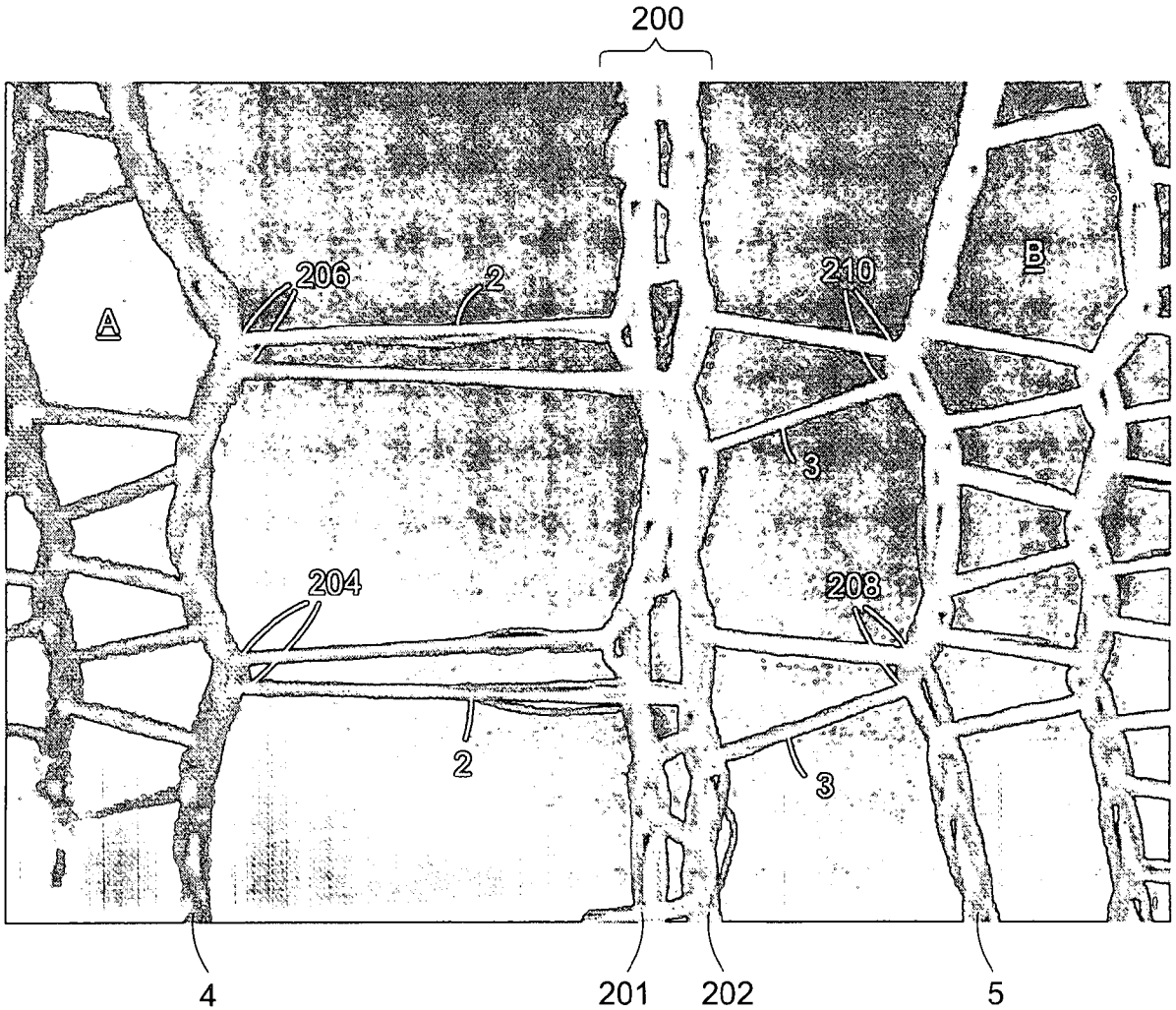
FIG. 4 is a plan view of the construction details of the tear-away fringe of the present invention.

Ideally, connector yarns 2 and 3 are formed of a filament-type yarn, having a lower tensile strength than the high tenacity polyester yarn used to form pillar stitches 1. FIG. 4 shows in greater detail the location of the pillar stitches and connector yarns forming tear-away fringe 200 between louvers A and B.

Figure 5:
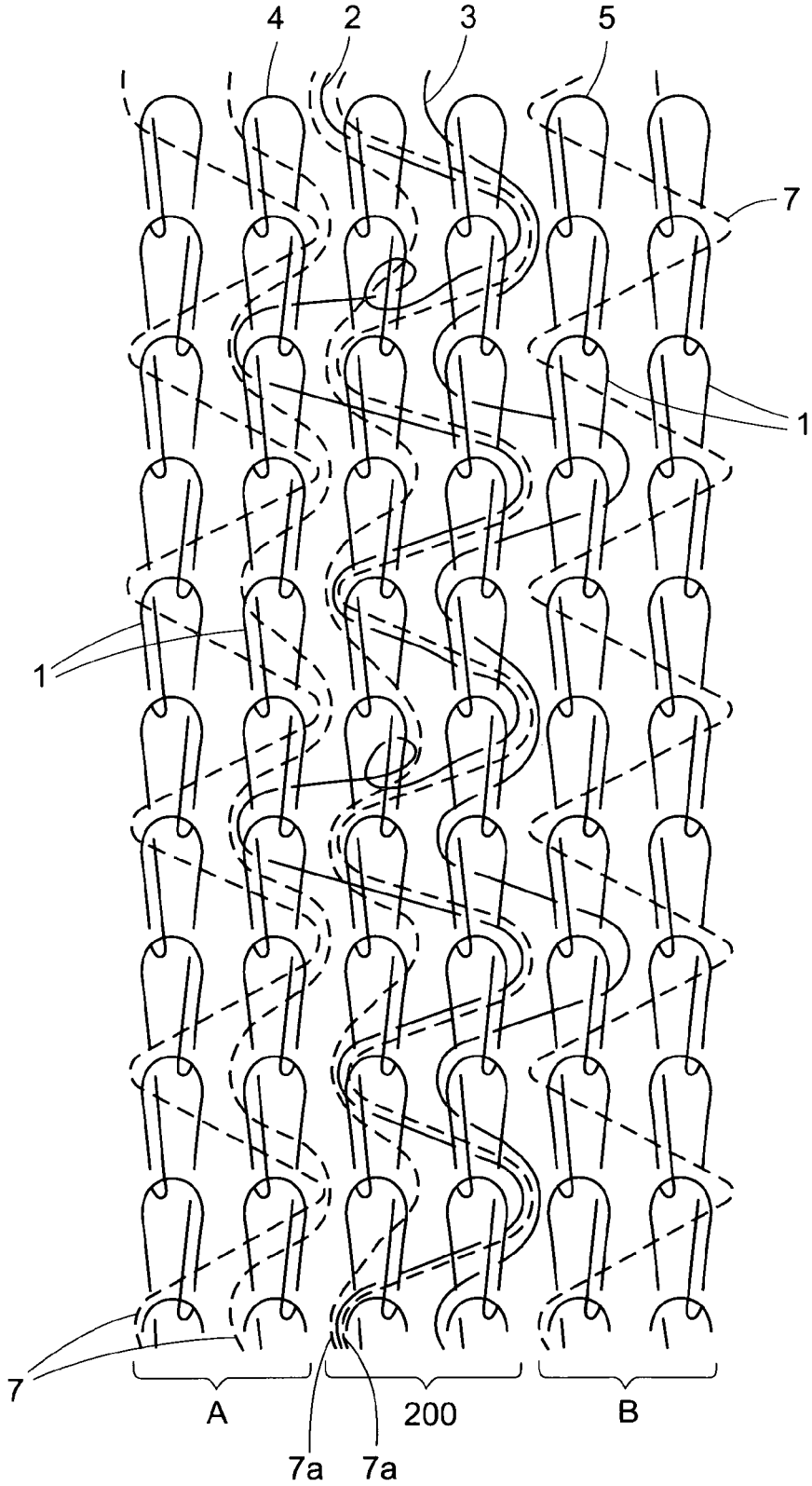
FIG. 5 is a schematic representation of an embodiment of the tear-away fringe of the present invention.

FIG. 5 is a schematic diagram similar to FIG. 3, indicating a possible traverse of additional pattern yarns 7, shown in dotted lines, relative to connector yarns 2 and 3 in tear away fringe 200. Pattern yarns 7 are used to traverse between the pillar stitches 1 of louvers A and B only. It is these pattern yarns 7 that give louvers A and B their strength and opacity. However, it is critical that the pattern yarns not traverse into tear away fringe 200. Instead, tear-away fringe 200 may have pattern yarns 7*a*, 7*a* to increase the strength of the tear-away fringe, although pattern yarns 7*a*, 7*a* similarly do not traverse into the pillar stitches which comprise louvers A or B.

In order to separate louvers A and B, tear away fringe 200 is pulled out of the fabric. Connector yarns 2 and 3, having a lower tensile strength than the surrounding pillar stitches, will break, causing louvers A and B to become disconnected. In a preferred embodiment, connector yarn 2 and 3 is more intimately intertwined with pillar stitches 201 and 202 and is only minimally intertwined with pillar stitches 4 and 5. As a result, the broken remnants of connector yarns 2 and 3 are more likely to remain lodged in tear away fringe 200 when torn from the fabric. This is advantageous, as tear away fringe 200 is discarded whereas louvers A and B remain free of loose yarn fragments and are immediately ready for use. An additional advantage accrues from the structure of louvers A and B which, due to the independent pillar stitches 1 which comprise them, are not weakened as a result of the removal of the connector yarns 2 and 3. On the contrary, the connector yarns are superfluous with respect to the structure of the louvers, and serve only to connect the louvers together into a single panel. This independent structure results in a clean edge that will not fray over time or as a result, for example, of machine washing.

As a result of attaching a set of louvers from a single vertical blind into a unitary fabric panel as shown in FIG. 1, the knitting of a horizontal design across the panels is greatly simplified as the panels can be manufactured simultaneously, and control over the horizontal alignment, and length of the panels can be made uniform. The result is a vertical blind which has a continuous appearance and attractively displays a horizontal pattern.

Figure 6:
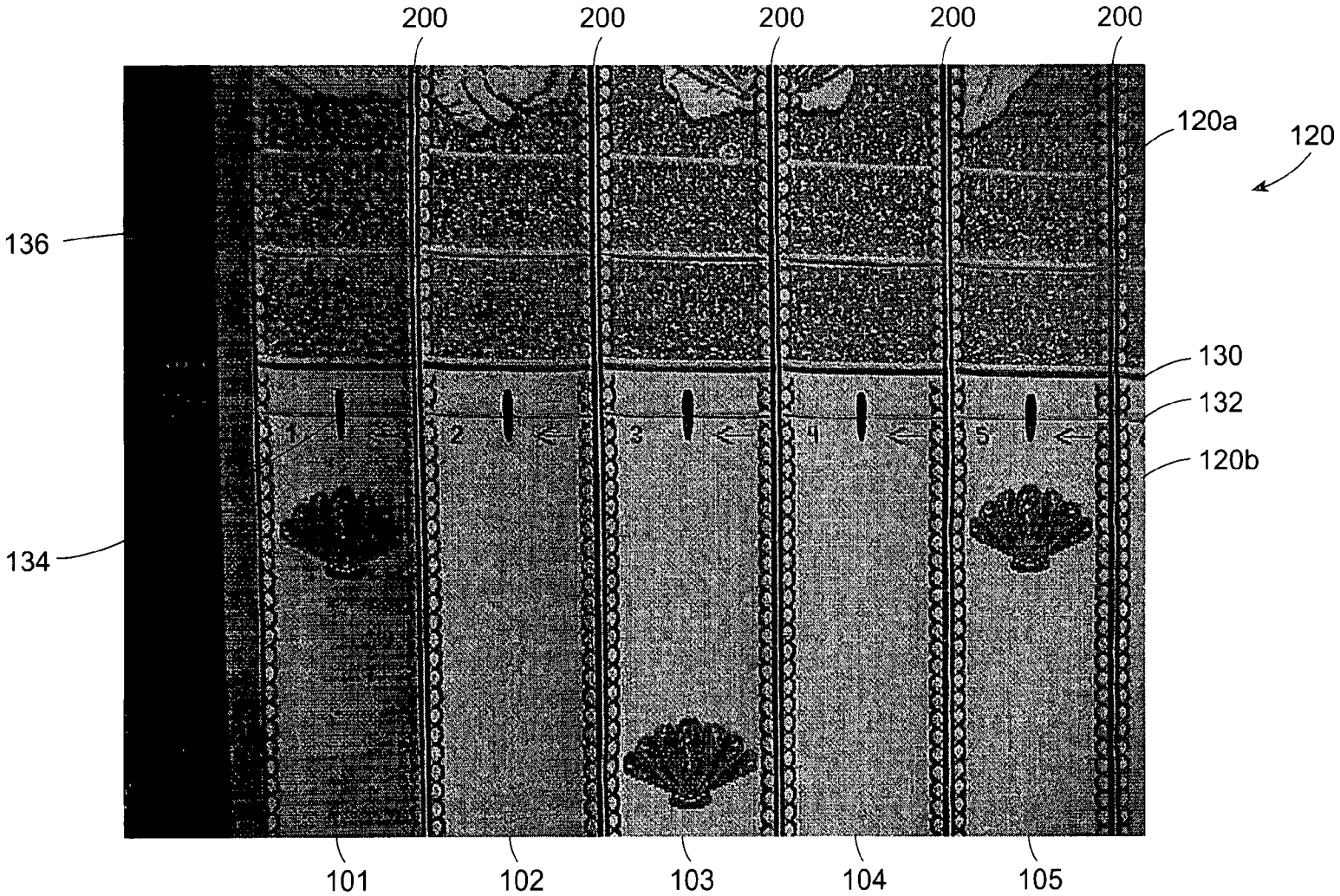
FIG. 6 is a fragmentary plan view of a fabric panel incorporating the present invention.

As shown in FIG. 6, a section of panel 120 is shown at the cutting line between the bottom of panel 120A and the top of panel 120B. Specifically, panels 101 through 105 are shown bordered by horizontal line 130 which divides the panels 120A and 120B. Tear away fringes 200 are also visible which demarcate the end of one louver and the start of another. Fold line 132 indicates where the top of louvers 101 through 105 are folded to allow for the insertion of hangers or mounting hardware, not shown. Holes on 134 may optionally be provided to allow for a mounting hook to pass through the louvers. Line 136 on the bottom, indicates fold and sew points for bottom weights which may optionally be provided to improve the performance of the louvers.

The installation of bottom weights and top hangers ideally takes place after knitting of the panels is complete, but prior to delivery of the finished blind to a consumer. Installation of the various hardware does not require separation of louvers 102 through 105 from each other, although the indication of a unique louver No. which is knitted into each of louvers 101 through 105 simplifies the installation of the blind, even if the louvers are separated prior to delivery to the consumer. Further, sequential numbering of the louvers in this manner permits the blind to be disassembled, for example, for the purpose of washing the louvers, without risk that the correct sequence of the louvers will not be known when the blind is reassembled.

Figure 7:
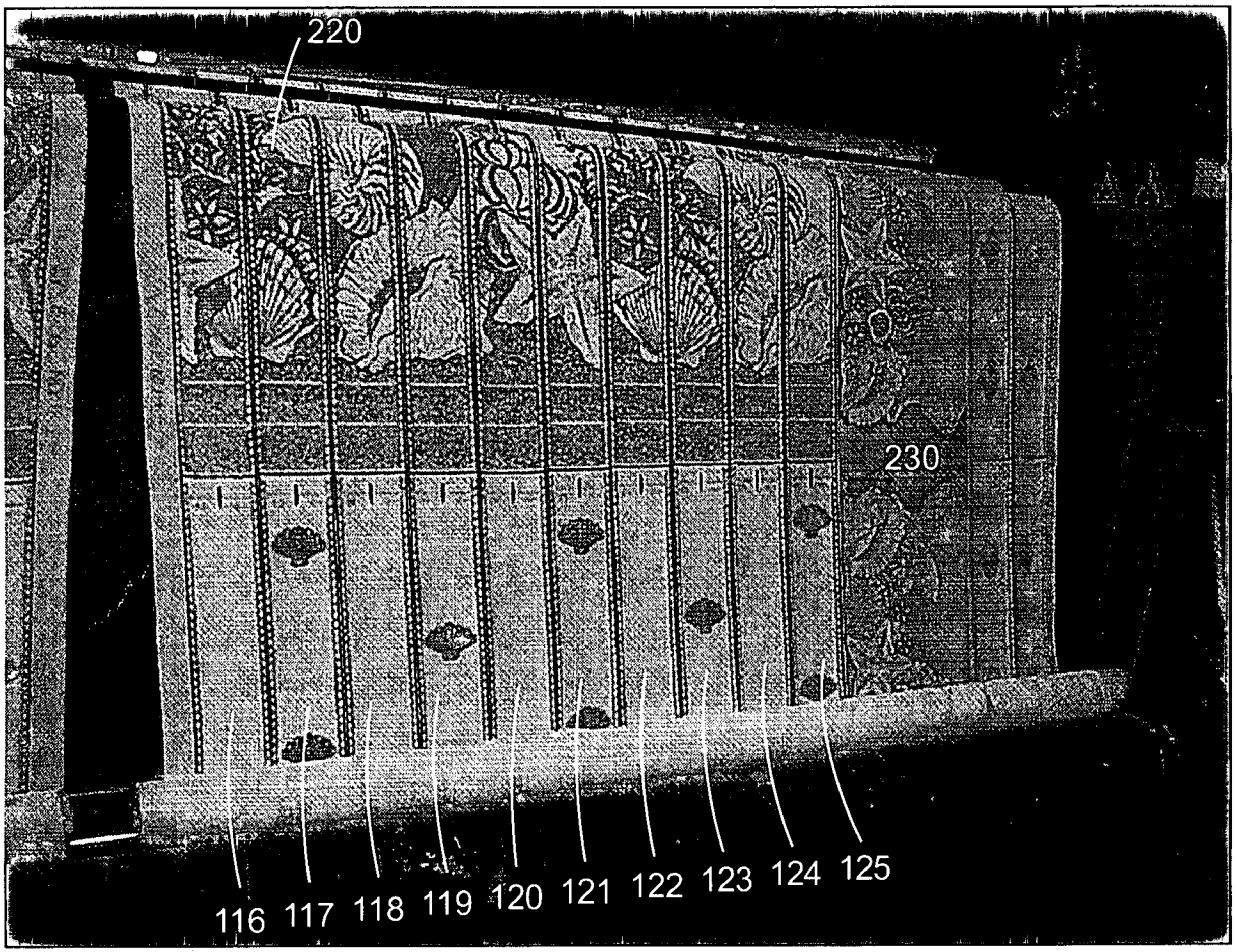
FIG. 7 is a perspective view of a fabric panel which includes the louvers and valance of a vertical blind incorporating the present invention partially rolled around a tube.

Ideally, a single panel of louvers is manufactured to sufficient width to accommodate the number of louvers required for a single blind. However, if the particular application calls for a blind having more louvers than can practicably be knitted into a single panel, continuation panels having the required number of louvers to complete the blind may be manufactured. As shown in FIG. 7, continuation panel 220 is shown in which louver 116 to 125 are manufactured. The louvers of continuation panel 120 are fabricated in the same manner as louvers 101-115, in that they are provided with horizontal fold and sew lines and are vertically divided by a tear away fringe. Furthermore, if a continuous horizontal pattern is provided in a previous panel, continuation panel 220 can incorporate a continuation of that horizontal pattern as shown in FIG. 7.

Additionally, components such as a valance may also be knitted into a continuation panel 220, for example when there is insufficient space on a previous panel to incorporate a valance. The valance 230 is knitted into continuation panel 220 ideally in the same manner as the individual louvers, specifically, by a tear away fringe which can be pulled away from panel 220 to separate valance 230.

During installation of a vertical blind comprising louvers fabricated on two separate panels, small discrepancies in horizontal alignment may develop between the panels due to normal variations in the knitting process. The results would be a small horizontal offset between the louvers of one panel and the louvers of another in the blind. A significant discrepancy would be immediately visible, particularly when a continuous horizontal pattern is provided across the louvers of the blind.

Dimensional variations occur naturally in the knitting process, and are the results of many factors such as machine tension, variations in yarns and ambient factory conditions. Dimensional drift of this kind typically occurs over the course of a manufacturing run in a gradual manner from the beginning of the run to its end. Therefore, the first panel produced during a manufacturing run is likely to deviate only slightly from the second or third panel in a run, whereas differences between the first and last panels are likely to be more significant. As a result, the panels in a multiple panel blind should be produced during the same manufacturing run, preferably so that each continuation panel is manufactured immediately after the preceding panel.

An arrangement of a second embodiment of a vertical blind incorporating the present invention is shown in FIGS. 8A-8D. FIGS. 9A-9D correspond generally to FIGS. 8A-8D and show a schematic representation of the operation of the blind of the second embodiment. Blind 300 is a combination blind having alternating substantially opaque fabric louvers 310 and sheer transparent or translucent fabric spacers 320, each of spacers 320 connecting together a spaced apart pair of louvers 310. The louvers may be provided with a hanger 330 at the top for pivotable support of louvers 310 from a traverse 332 and may have a weight at the bottom (not shown) to bias the louvers vertically. Traverse 332 permits pivotable movement of louvers 310 between an open and a closed orientation.

Figure 8A:
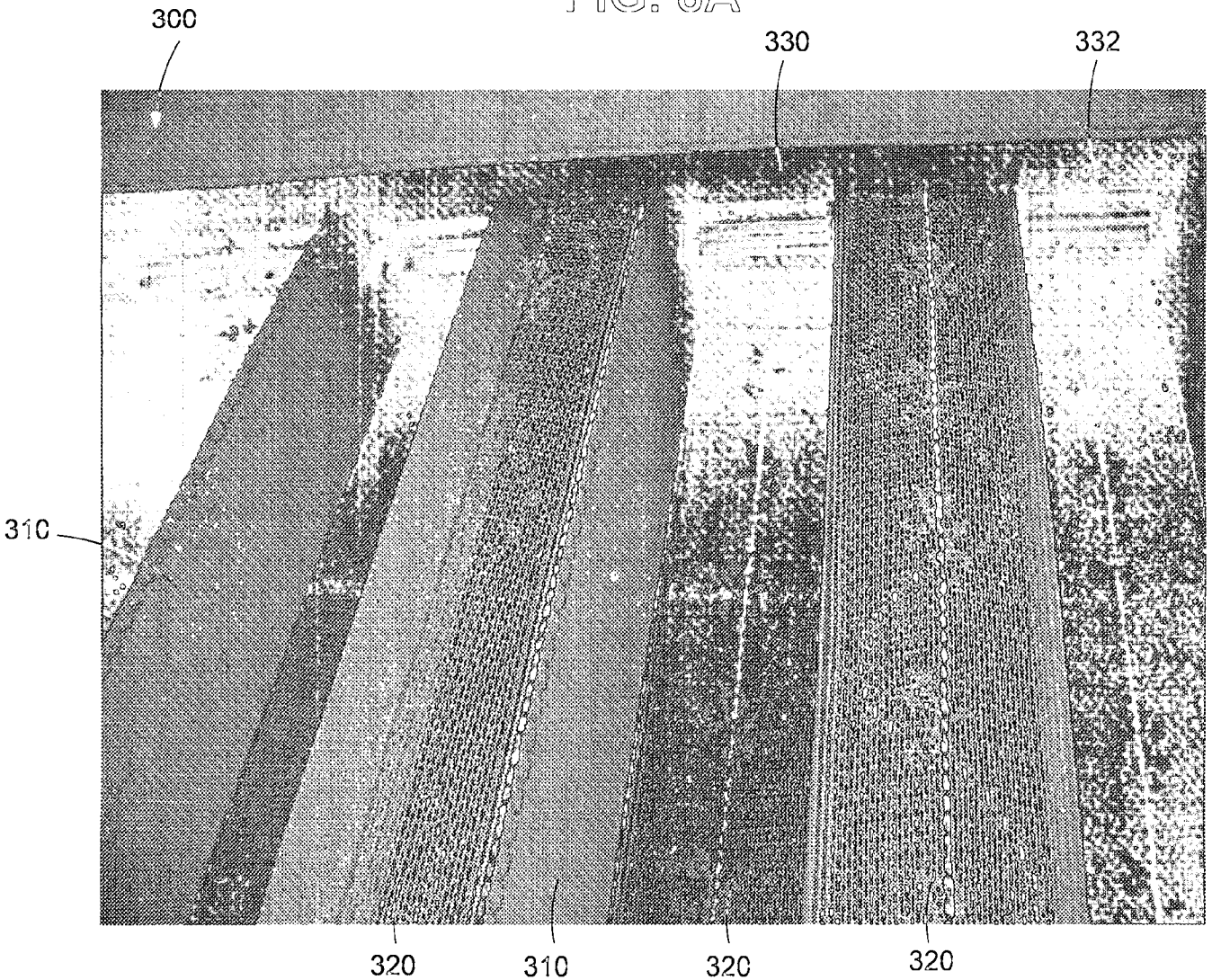
FIGS. 8*a* through 8*d* are bottom perspective views of an embodiment of a combination blind incorporating the frangible hinges of the present invention.
Figure 9A:
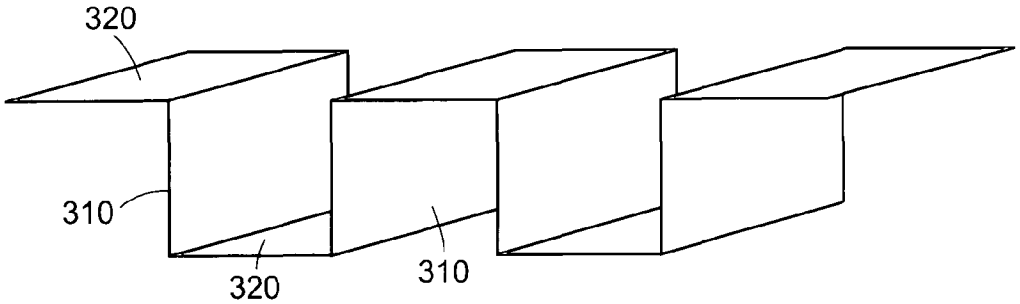
FIGS. 9*a* through 9*d* are graphical representations of the combination blind of the present invention.

FIGS. 8A and 9A illustrate the open orientation, wherein louvers 310 are generally transverse to traverse 332 and parallel to one another. Spacers 320 are generally parallel to another, extending horizontally between louvers 310, alternatively in one of two common planes parallel to traverse 332. Spacers 320 permit the passage of light therethrough, whereas the transverse orientation of opaque louvers 310 allows light to pass.

Figure 8B:
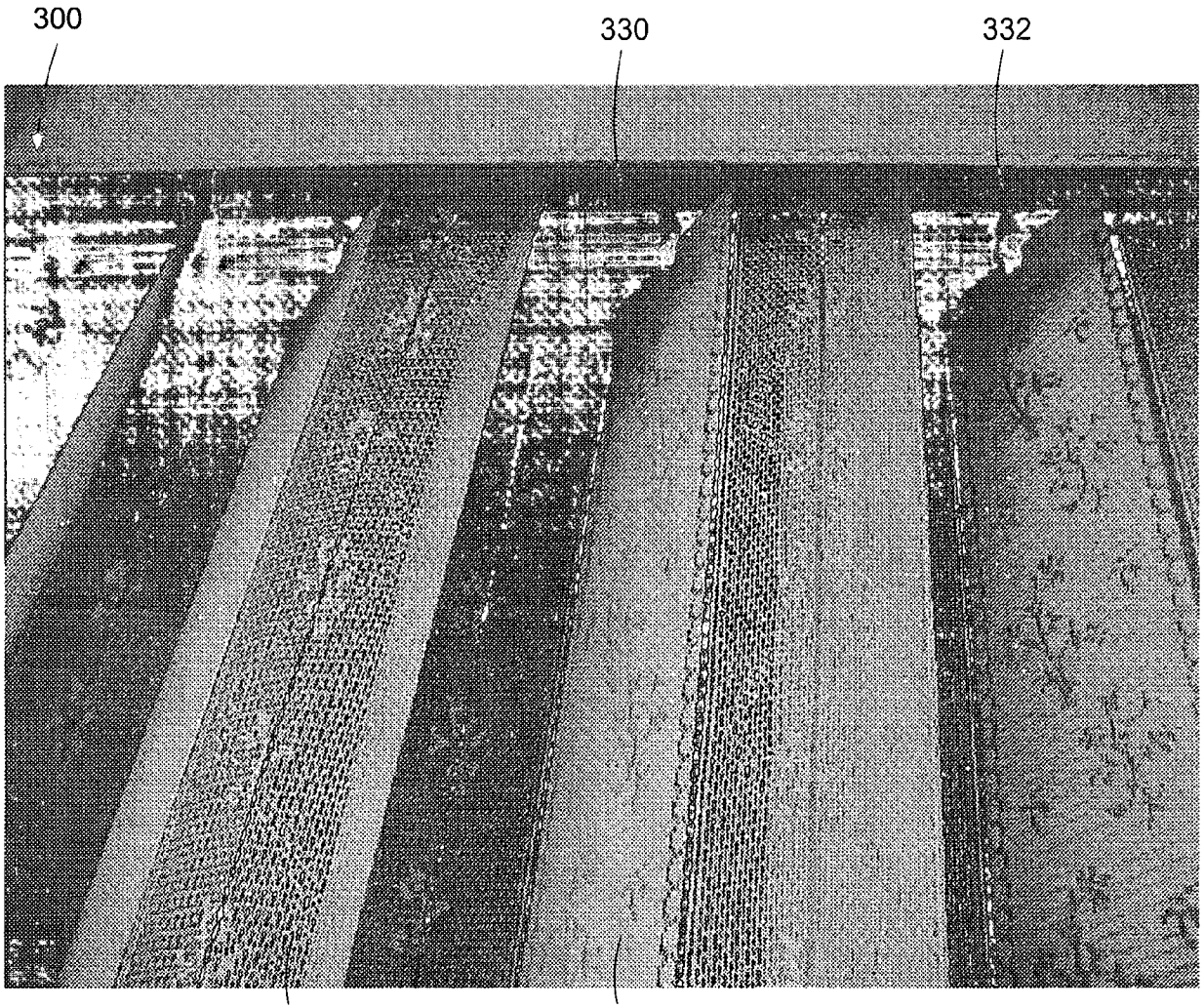
Figure 9B:
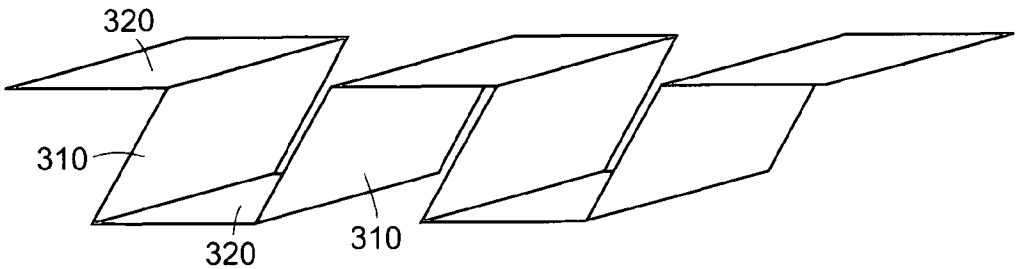

FIGS. 8B and 9B illustrate the blind of the present invention in a partially closed orientation. Louvers 310 have been rotated at hooks 330 to deviate from the transverse orientation that defines the open position. Although louvers 310 are still parallel, having been rotated in unison, there is now a partial blockage of light due to the angle of louvers 310. Similarly, spacers 320 are only partially blocked, therefore admitting some light, albeit less than in the open position.

Figure 8C:
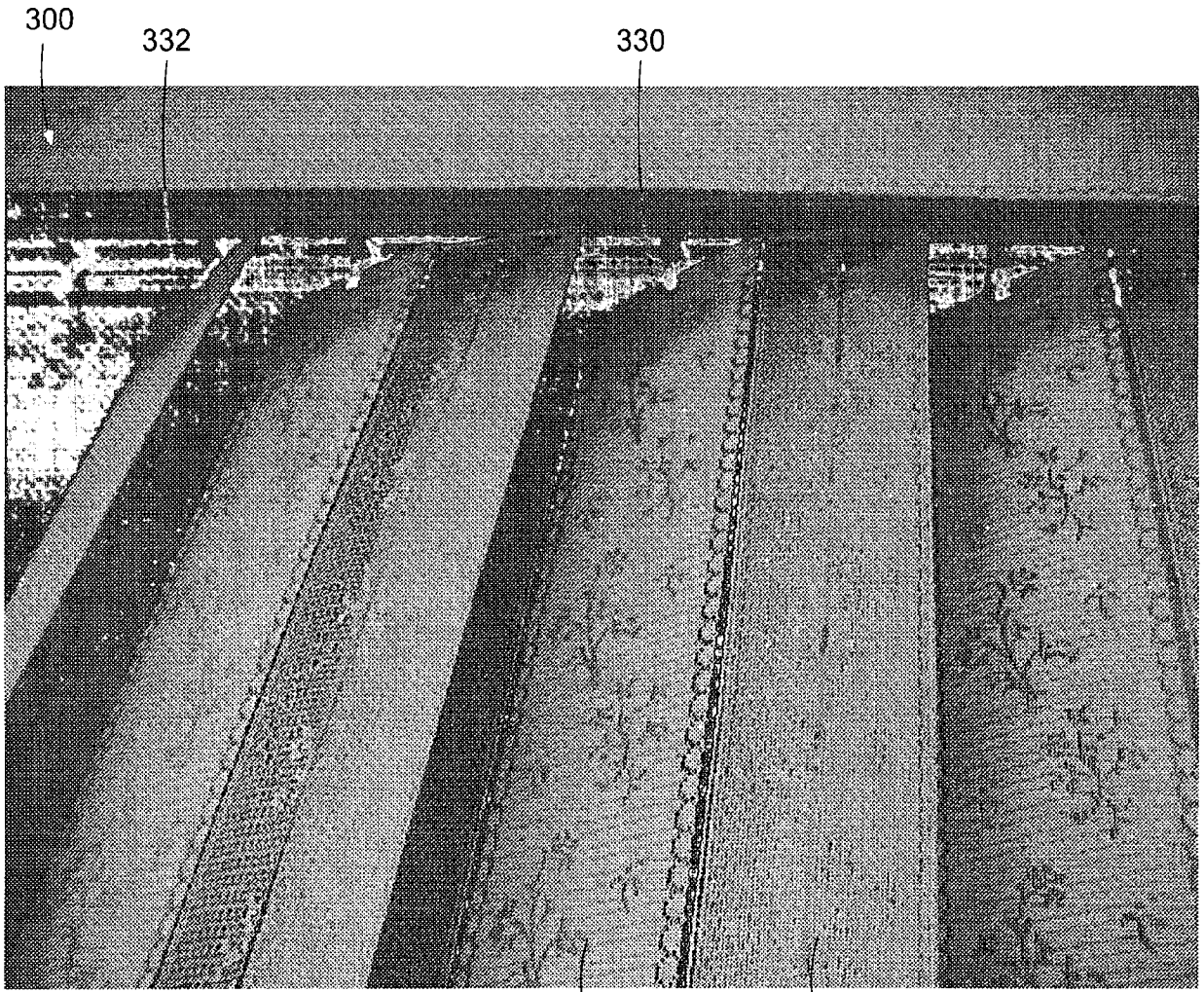
Figure 9C:
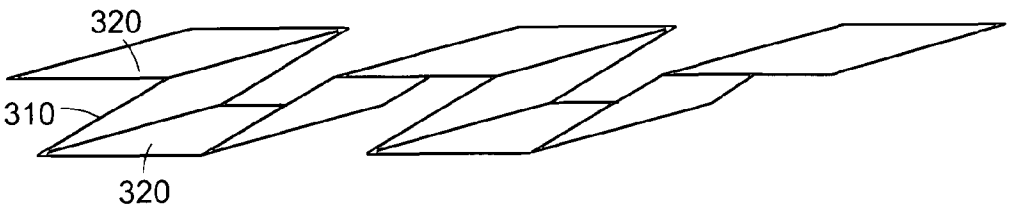

FIGS. 8*c* and 9*c* illustrate a further closing of blind 300. In this position, louvers 310 have been rotated still further from their original transverse orientation, thus blocking more light. Louvers 310 are still parallel, although they are now nearly parallel to traverse 332, revealing the patterns on the surface of louvers 310. Similarly, spacers 320, while still admitting some light, are nearly blocked by the action of louvers 310.

Figure 8D:
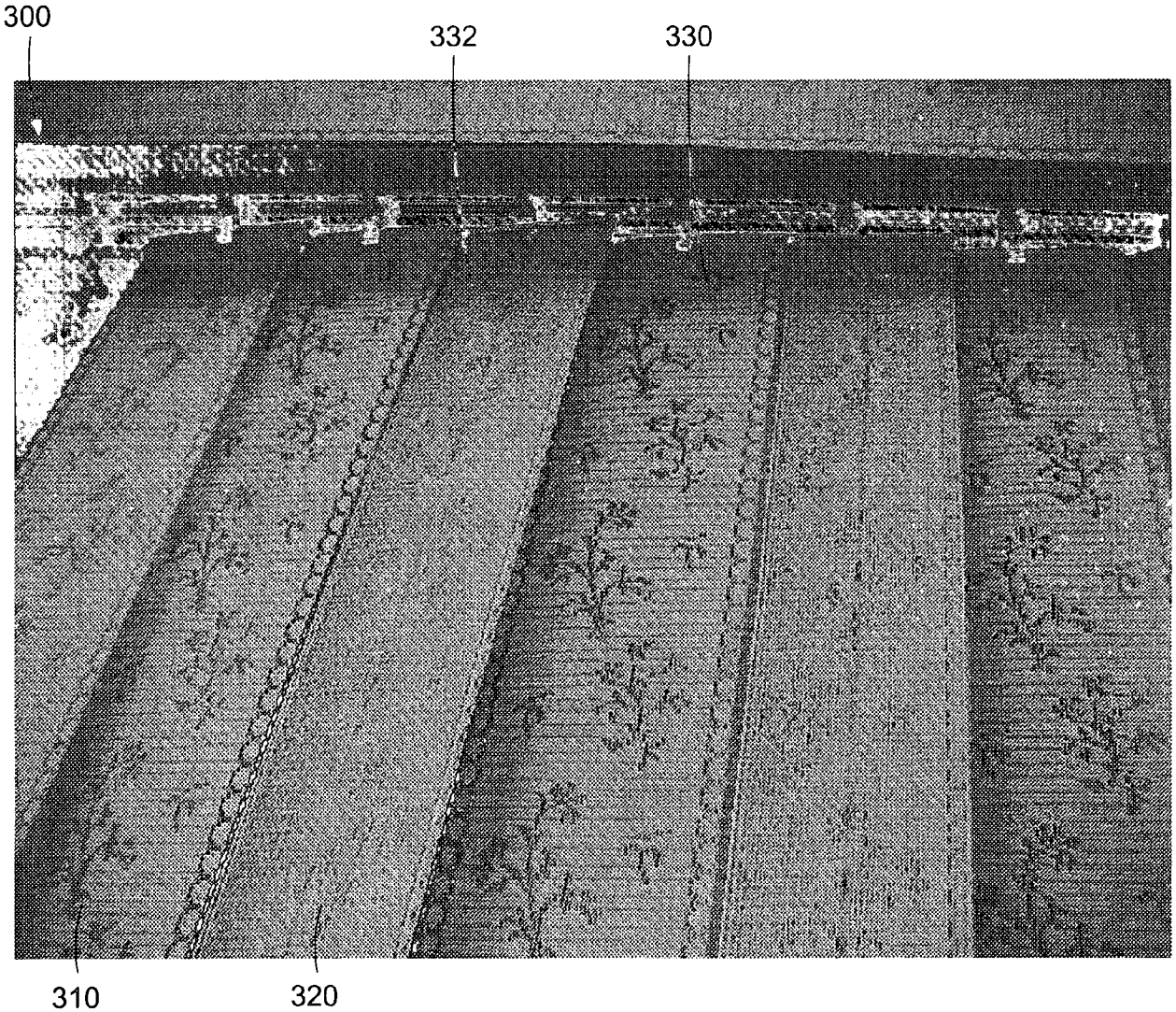
Figure 9D:
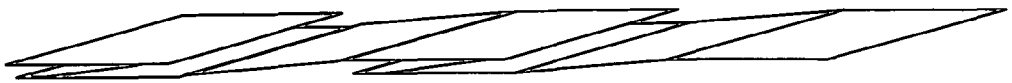

FIGS. 8*d* and 9*d* illustrate blind 300 in a completely closed orientation. Louvers 310 have been rotated 90° from their original, transverse orientation, and are now parallel to traverse 332. The distance between louvers 310 is less than or equal to their width, therefore louvers 310 overlap, substantially completely blocking the passage of light therethrough. Spacers 320 are still visible over alternate louvers 310, although no light passes through spacers 320 due to the positioning of louvers 310.

Figure 10A:
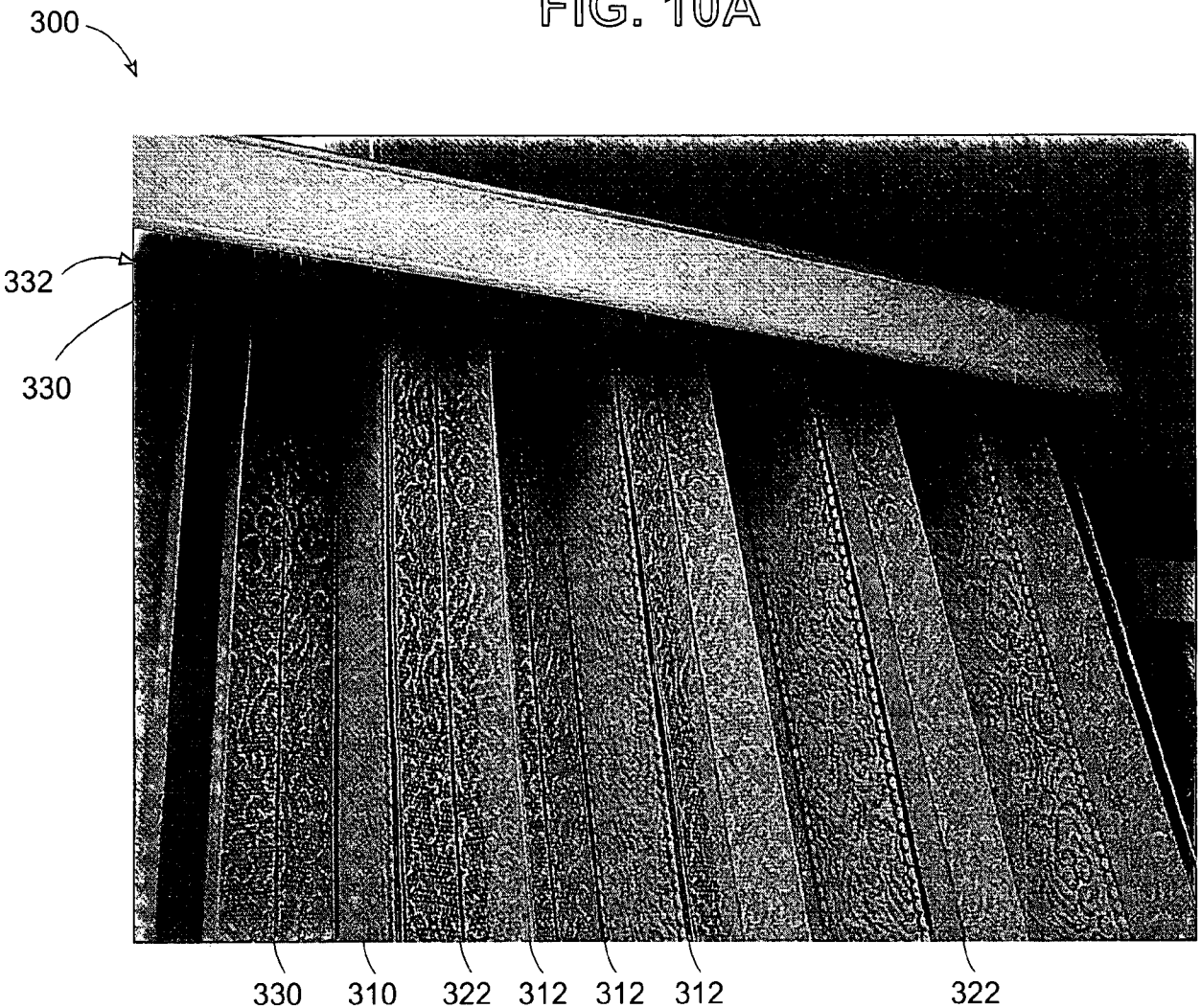
FIGS. 10*a* through 10*c* are partial bottom perspective views demonstrating the function of the frangible hinges of the present invention as incorporated in a combination blind.
Figure 10B:
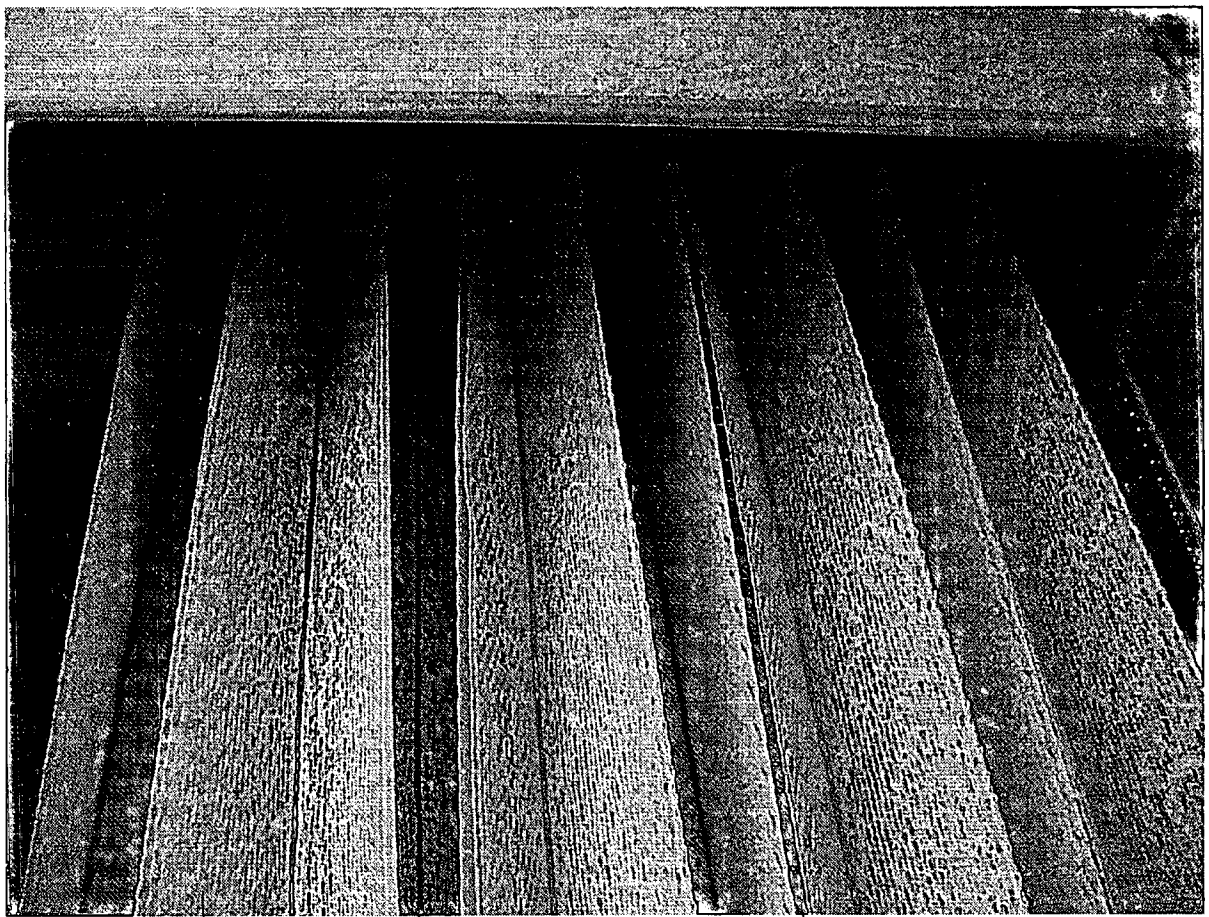
Figure 10C:
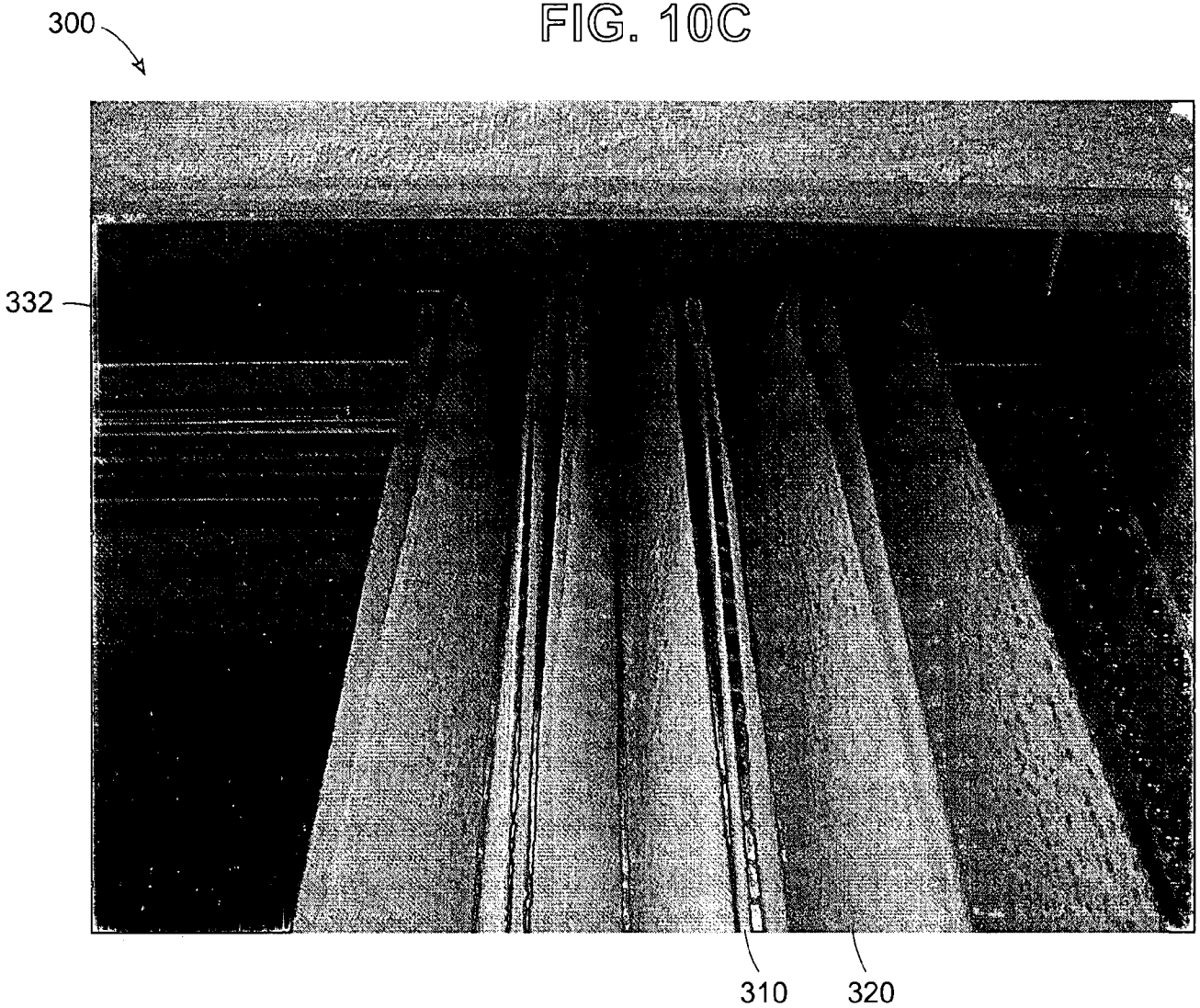

Blind 300 may also be drawn to one or both sides of traverse 332 as shown in FIGS. 10*a* through 10*c*. 10*a* illustrates line 300 fully extended with louvers 310 in the open position. Hinges 312 between louvers 310 and spacers 320 are shown as well as intermediate hinge 322.

FIG. 10*b* illustrates line 300 shown partially drawn to one side. The operation of frangible hinges 312 and 322 is visible as spacers 320 fold in an inward direction as line 300 is drawn. FIG. 10*c* illustrates line 300 completely drawn to the side, to the mechanical limit of traverse 332, illustrating the manner in which louvers 310 and spacers 320 fold against each other.

Figure 11:
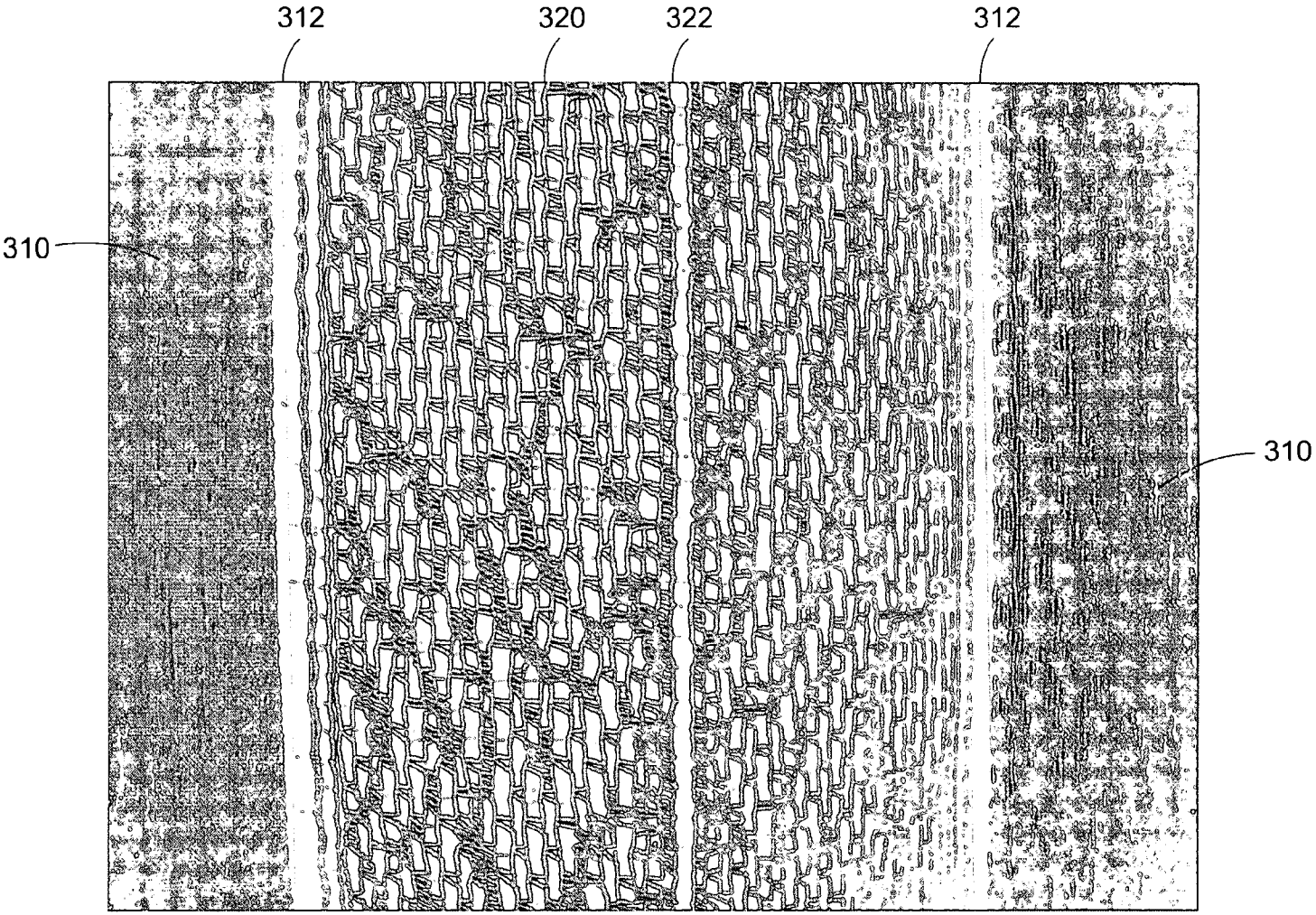
FIG. 11 is a partial plan view of a section of a combination blind of the present invention.

FIG. 11 illustrates the hinging mechanism of the present invention in greater detail. Spacer 320 is shown attached by hinges 312 to louvers 310 on either side thereof. Hinges 312 as well as intermediate hinge 322 extend vertically from the top to the bottom of spacer 320.

Figure 12:
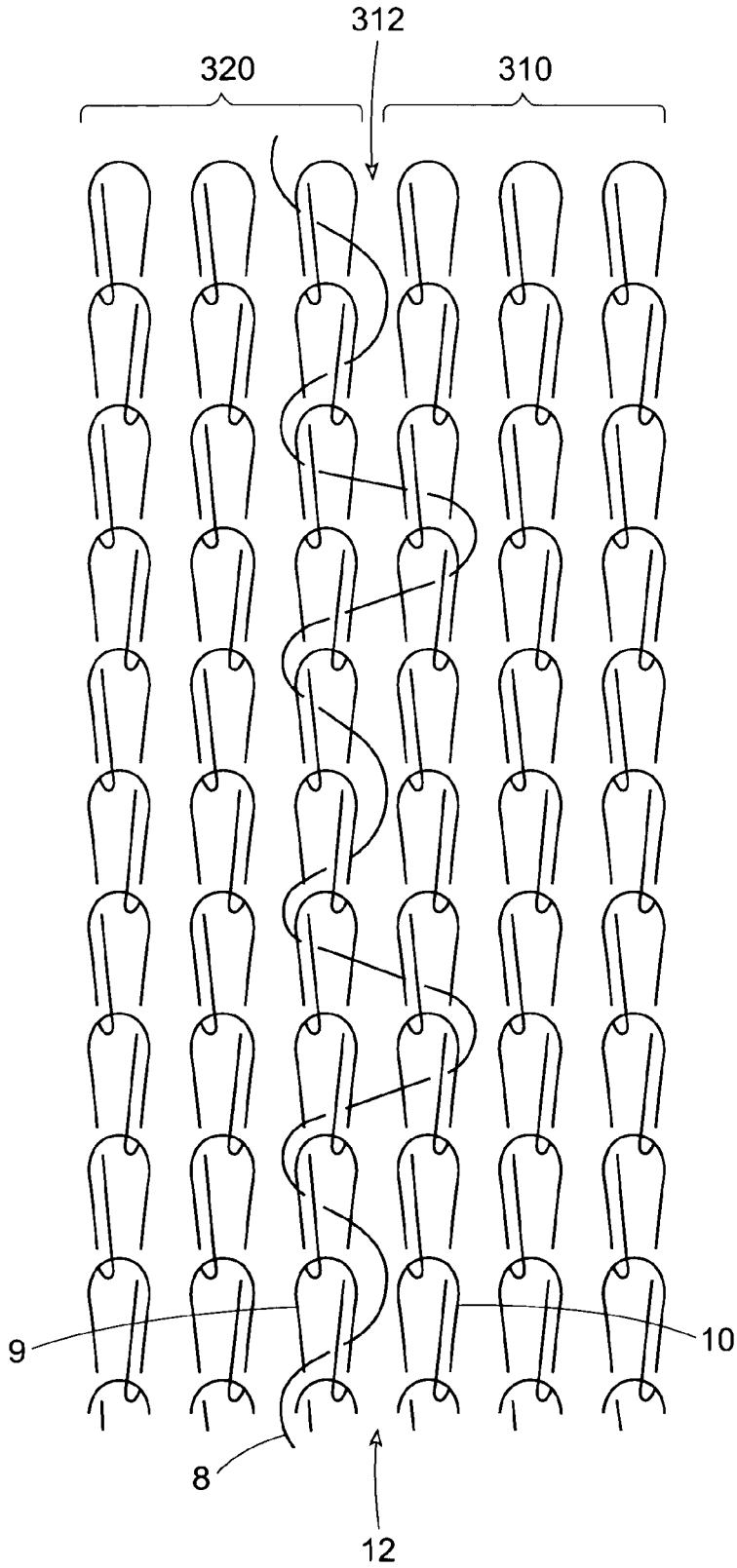
FIG. 12 is a schematic representation of the frangible hinge of the present invention.

FIG. 12 is a schematic representation of frangible hinge 312. Item 9 is a representation of the rightmost pillar stitch in the structure of spacer 320. The number of pillar stitches which comprise a spacer depend upon the width and appearance of the spacer, a typical number of stitches being about 25. However, there is no limitation on the number of pillar stitches which comprise a spacer for purposes of the present invention. For simplicity, only three pillar stitches in spacer 320 are illustrated. 10 represents the leftmost pillar stitch in louver 310, again only three pillar stitches of which are shown in FIG. 12. Connector yarn, 8 which forms the structure for hinge 312 traverses the edge pillar of spacer 320 and, where desired to form a connection, also traverses space 12 between spacer 320 and louver 310. The connector yarn is the only yarn that traverses this space. It is this arrangement that forms frangible hinge 312 along which the louvers and spacers fold.

Intermediate hinges 322 are preferably fabricated in the same manner, and are therefore similarly frangible. The placement of intermediate hinges 322 define the manner in which spacers 320 collapse when blind 300 is drawn. Therefore, the hinge 322 may be omitted entirely to produce a soft edge, or multiple hinges may be provided to produce a more accordion-like pattern.

The frequency and number of connections forming a frangible hinge can vary. This allows for adjustments to the strength of the connection, the flexibility of the hinge and incorporation of the hinge into the design.

The pillar stitches including 9 and 10 are preferably formed of a high tenacity yarn, whereas connector yarn 8 is preferably a yarn having a lower tenacity, thereby rendering hinge 312 frangible. The use of a lower tenacity yarn for connector yarn 8, preferably a filament yarn, provides the additional advantage of allowing a preferential folding direction or memory to be imparted onto the hinges. This can be accomplished by folding the hinges in a desired preferential direction and allowing them to remain in this position for a period of time, as in a package for delivery or sale.

Figure 13:
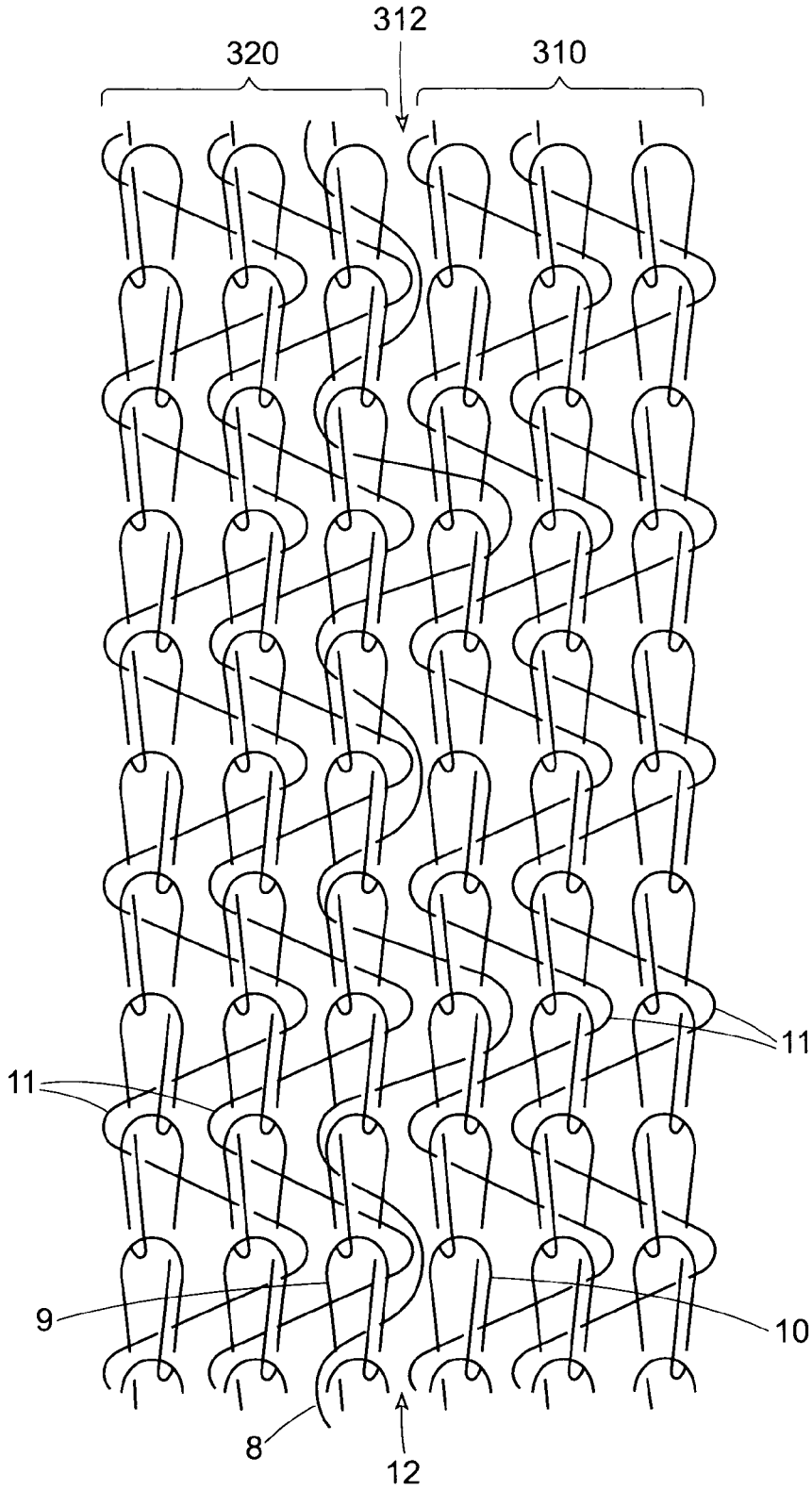
FIG. 13 is a schematic representation of the frangible hinge of the present invention.

FIG. 13 illustrates the same hinge mechanism as FIG. 12, however where FIG. 12 illustrates only the pillar stitches and a single connector yarn, FIG. 13 shows a preferred orientation of additional yarns 11 which traverse the pillar stitches of spaces 320 and louver 310 respectively. Yarns 11 increase the appearance of fabric structure, but do not traverse the space between spacer 320 and louver 310. It is only the connector yarn 8 that traverses this space. Therefore, similar to the tear away fringe disclosed in the previous embodiment, the structure of frangible hinge 312 is such that if the fabric was torn apart at space 12, the connector yarn would break permitting spacer 320 to separate from louver 310. As shown in FIGS. 12 and 13 connector yarn 8 is more intimately intertwined with pillar stitch 9 of spacer 320 and only incidentally intertwined with pillar stitch 10 of louver 310. This structure increases the likelihood that, upon tearing apart of louver 320 and spacer 310, the remnants of torn connector yarn 8 would remain embedded in spacer 320, leaving a clean edge on louver 310.

Because combination blind 300 is manufactured from a single panel, there is ideally a mechanism that allows the louvers 310 to rotate from an open to a closed position. Additionally, there is ideally a means by which the spacers 320 can collapse onto each other as the louvers are gathered together as the blind is drawn.

Therefore, frangible hinges 312 serve a dual purpose. First, the frangible hinges serve as a hinge member flexibly connect the louvers 310 to spacers 320 and permit relative movement between the louver and spacers while limiting any flexing of the fabric to the frangible hinges. As noted above, the selection of the type of yarn used for connector yarn 8 is preferably a type which is inherently more flexible than the yarns which are used to form the surrounding structure and pillar stitches. This applies equally to frangible intermediate hinges 322, which may be constructed in the same manner.

Figure 14:
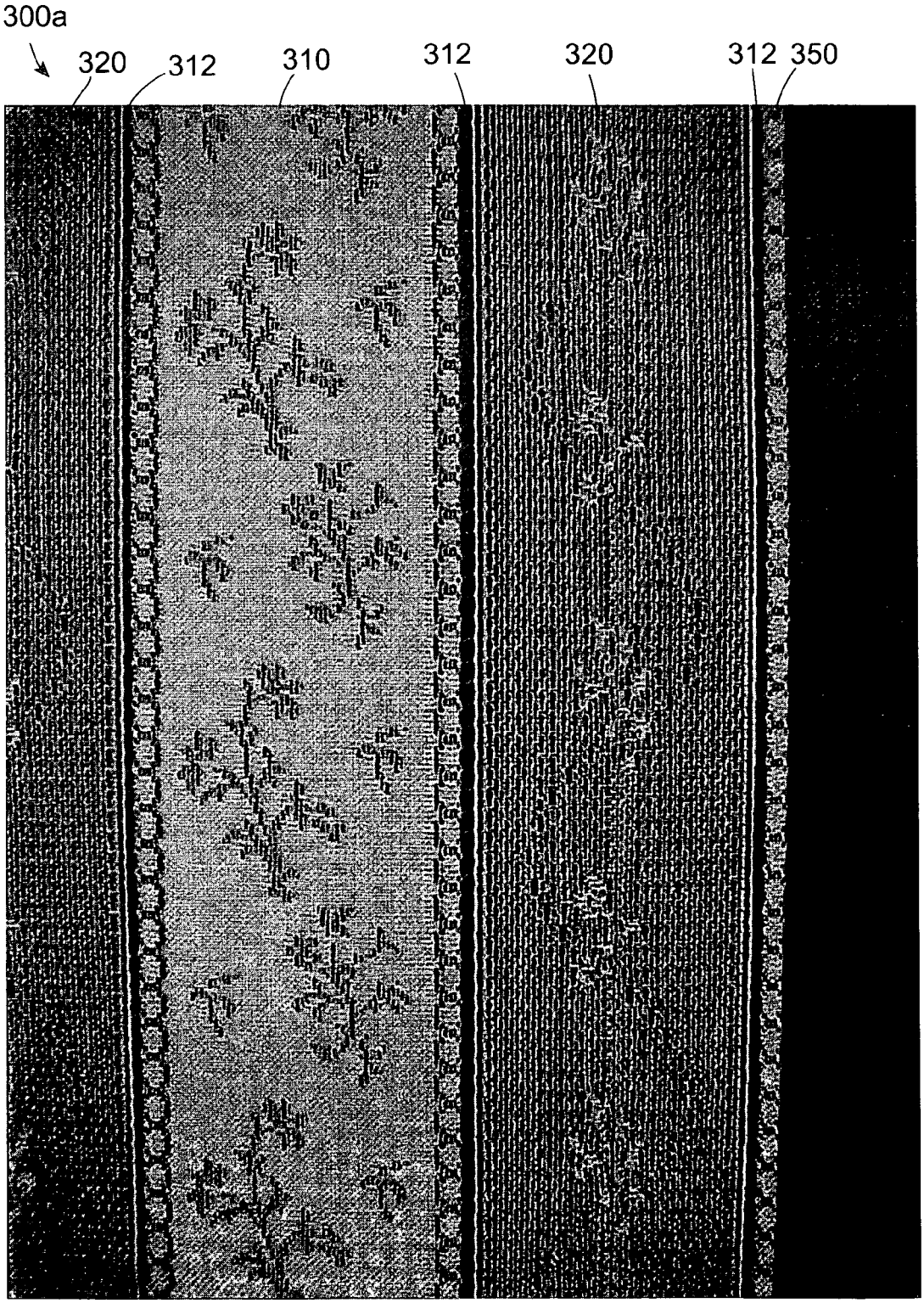
FIG. 14 is a partial plan view of a section of a combination blind.
Figure 15:
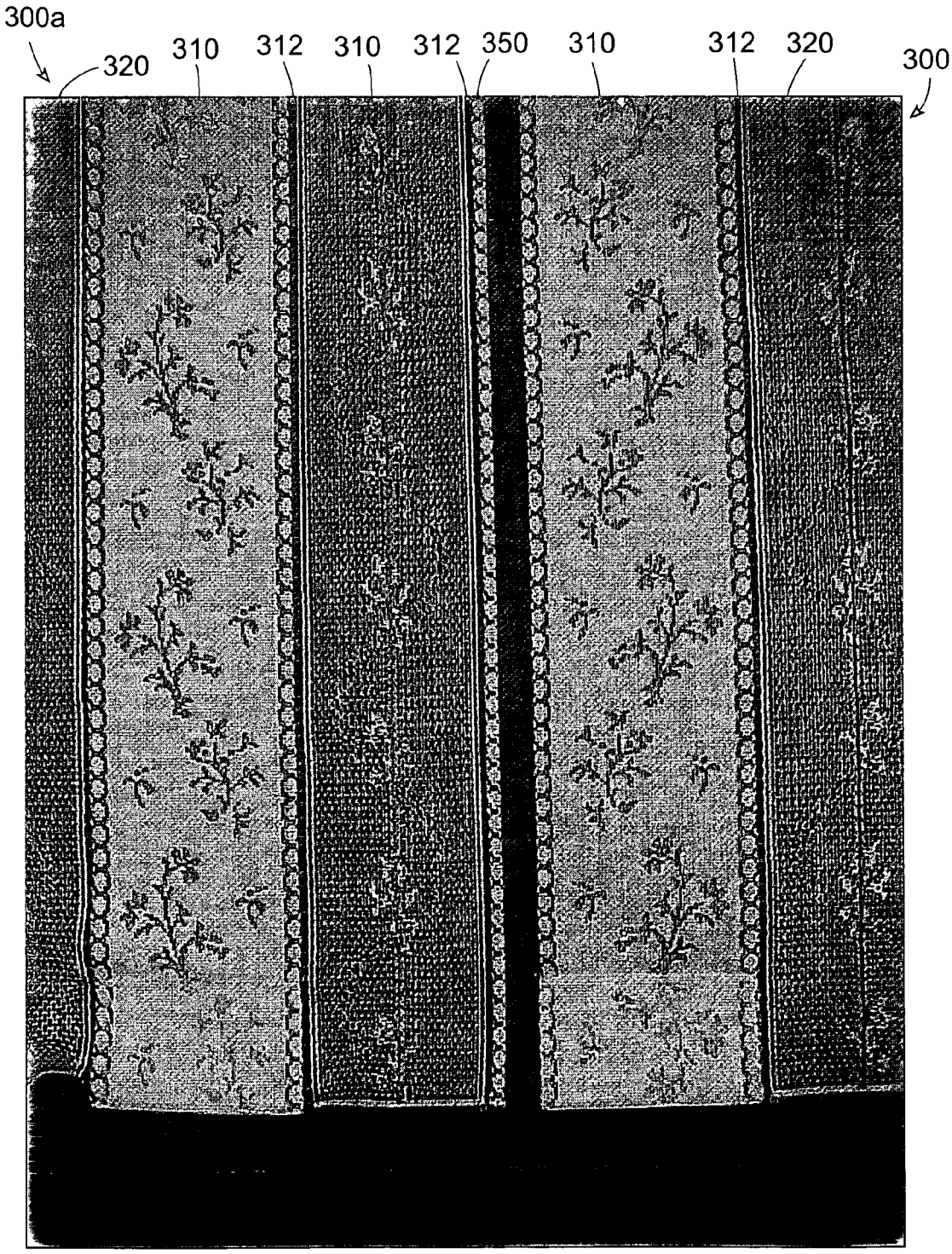
FIG. 15 is a partial plan view of two types of combination blinds incorporating the frangible hinge of the present invention.
Figure 16:
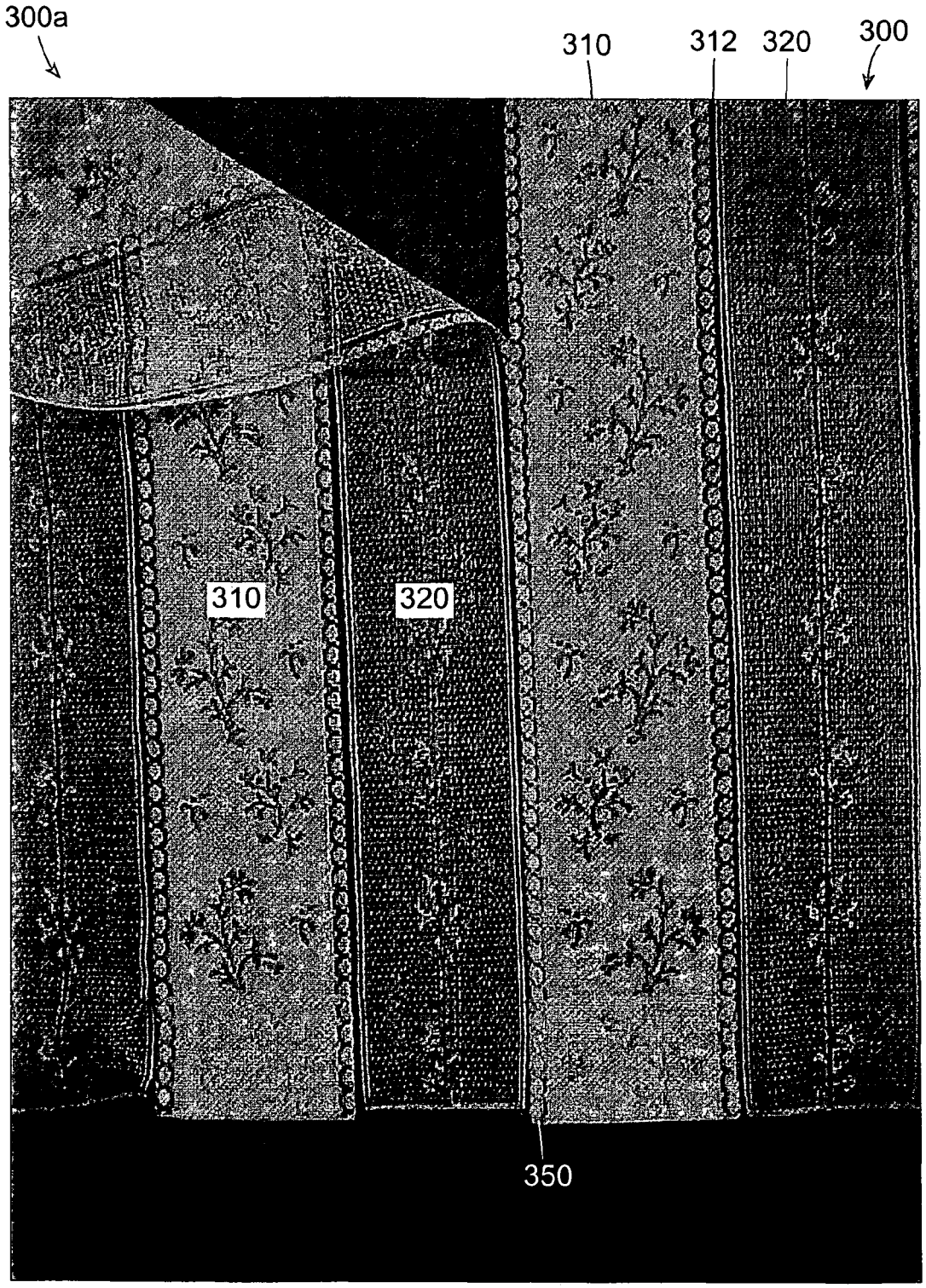
FIG. 16 is a partial plan view demonstrating the manner in which two combination blind panels of the present invention can be combined into a single combination blind.

The second function served by frangible hinges 312 is to permit part of the blind to be torn away without damaging any of its components. For example, when a blind fabricated in a single panel is too wide for a specific application, the excess louvers and spacers can be torn away, and discarded, the remaining blind having the desired width. The frangible hinges also permit the conversion of a combination blind into a conventional vertical blind, by simply tearing away each of spacers 320 from a single panel and discarding them, leaving a plurality of louvers 310 which would function in the same manner as the louvers of the vertical blind of the first embodiment. As shown in FIGS. 14-16, the design of combination blind 300 incorporates a number of fabric louvers 310 seamlessly connected together at frangible hinges 312 by sheer fabric spacers 320. Each blind panel 300, when manufactured, begins and ends in either a louver 310 or a spacer 320. As a result, two or more panels can be connected together, side by side, to accommodate a traverse of any length with any desired or required number of louvers. Thus, the combination blind panels are ideally manufactured in two versions. The first version 300 begins and ends with a louver 310 and is intended for any installation. The second version 300A begins and ends with a spacer 320. Attached to the outside edge of the end spacer 320 via a hinge 312 as previously described, will be a thin strip 350 of fabric that mimics the pattern along the edge of a louver 310.

The panels of a combination blind can be joined together in one of two ways. In a first way, a hot melt adhesive yarn will be knit into the fabric structure on the underside thin strip 350. Thin strip 350 may be layered on top of an edge of the end louver 310 of blind panel 300 and then heat may be applied (such as by the use of a conventional home iron) to melt the adhesive yarn to adhered thin strip 350 to the edge of louver 310 of blind panel 300. In a second way, a strip of hot melt adhesive film may be applied to the underside of thin strip 350. Thin strip 350 could be adhered to louver 310 of blind panel 300 by the adhesive film in a manner similar to that of the first method.

As shown in FIG. 14, blind panel 300A is shown having alternating louvers 310 and spacers 320 terminating in a spacer 320 which is connected to thin strip 350 by frangible hinge 312. As shown in FIG. 15, thin strip 350 of blind panel 300A is arranged adjacent to end louver 310 of blind panel 300.

FIG. 16 illustrates the alignment of thin strip 350 over the edge of louver 310 of blind panel 300. Adhering the panels together in this manner, frangible hinges 312 between end spacer 310 and thin strip 350 on blind panel 300A function in the same manner as the frangible hinges between the louvers and spacers of the remainder of the blind. Therefore, after blind panels 300A and 300 are joined at thin strip 350, the combined panels functions as a single vertical combination blind.

A wide variety of adhesives may be used to render thin strip 350 adhesive. For example, hot melt adhesive coated yarns, including part number 90X312116 produced by Engineered Yarns Company of Fall River, Mass. is a yarn provided with a polyamide hot melt coating suitable for adhering fabrics at a temperature between 280 and 300° F. Alternatively, a hot melt adhesive strip such as a transparent polyurethane, product number 3410 manufactured by Bemis of Shirely, Mass. is also suitable for adhering blind panel 300A. Other adhesives which are suitable for fabric will be known to a person of skill in the art to accomplish the same purpose.

Figure 17:
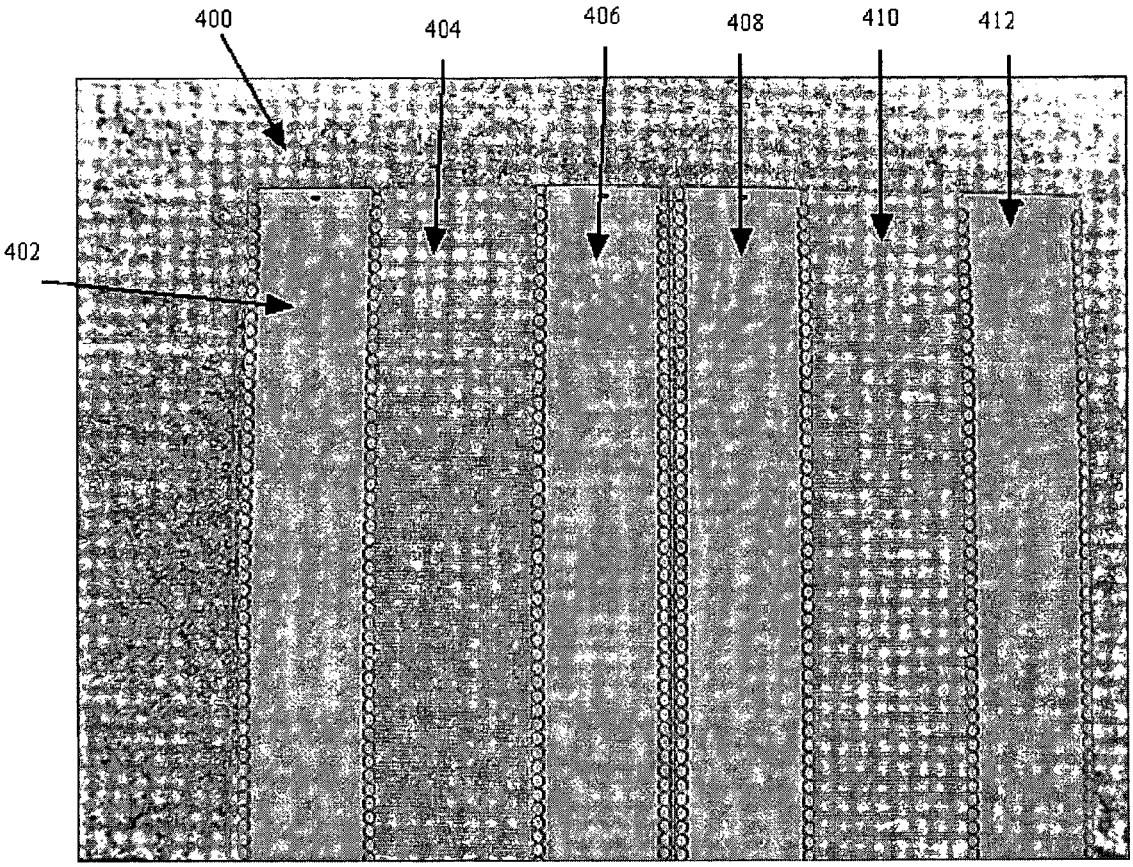
FIG. 17 is a partial plan view of a vertical blind panel according to another exemplary embodiment of the invention.

FIG. 17 shows a vertical blind panel 400 according to another exemplary embodiment of the invention. In this embodiment, the vertical blind panel 400 includes a first relatively opaque fabric louver 402 extending vertically across the panel 400. The first louver 402 is joined to a vertically-extending, relatively sheer spacer 404. A second relatively opaque fabric louver 406 is joined to the spacer 404. This pattern then repeats itself, so that the panel 400 also includes a third relatively opaque fabric louver 408 joined to the second louver 406, a second shear spacer 410 joined to the second louver 406, and a fourth louver 412 joined to the second spacer 410. In a larger panel structure, this order of three strips continues to repeat, with each repetition connecting to the last to form the width of the panel 400. Each louver is preferably about 3½ inches in width, and the width of each spacer is preferably in a range of about 3¼ to about 4½ inches, although the louvers and spacers may have any other suitable width. All of the strips in a panel are preferably manufactured simultaneously and as a contiguous fabric panel.

Figure 18:
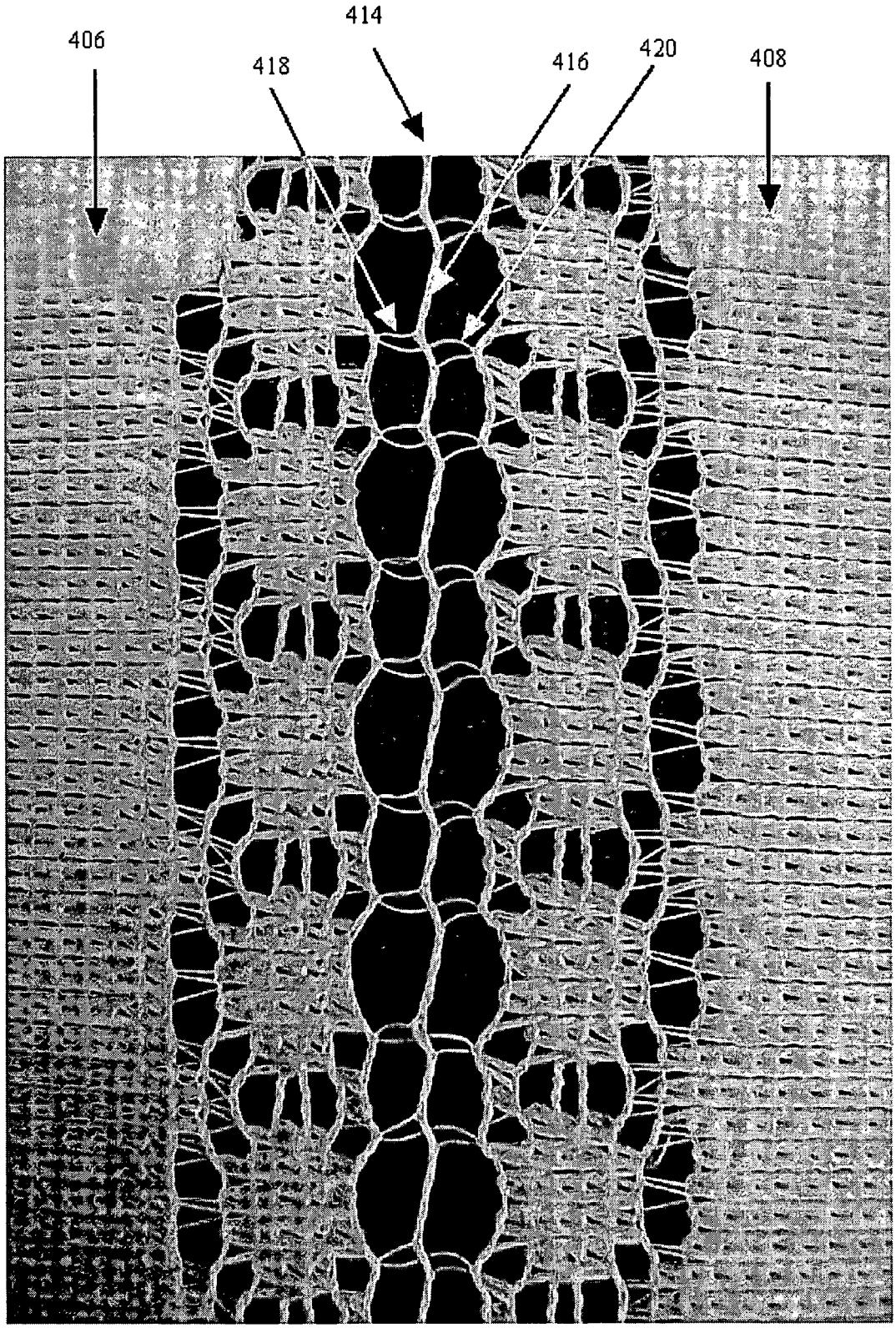
FIG. 18 is a partial plan view showing a hinge connecting two louvers in the vertical blind panel of FIG. 17.
Figure 19:
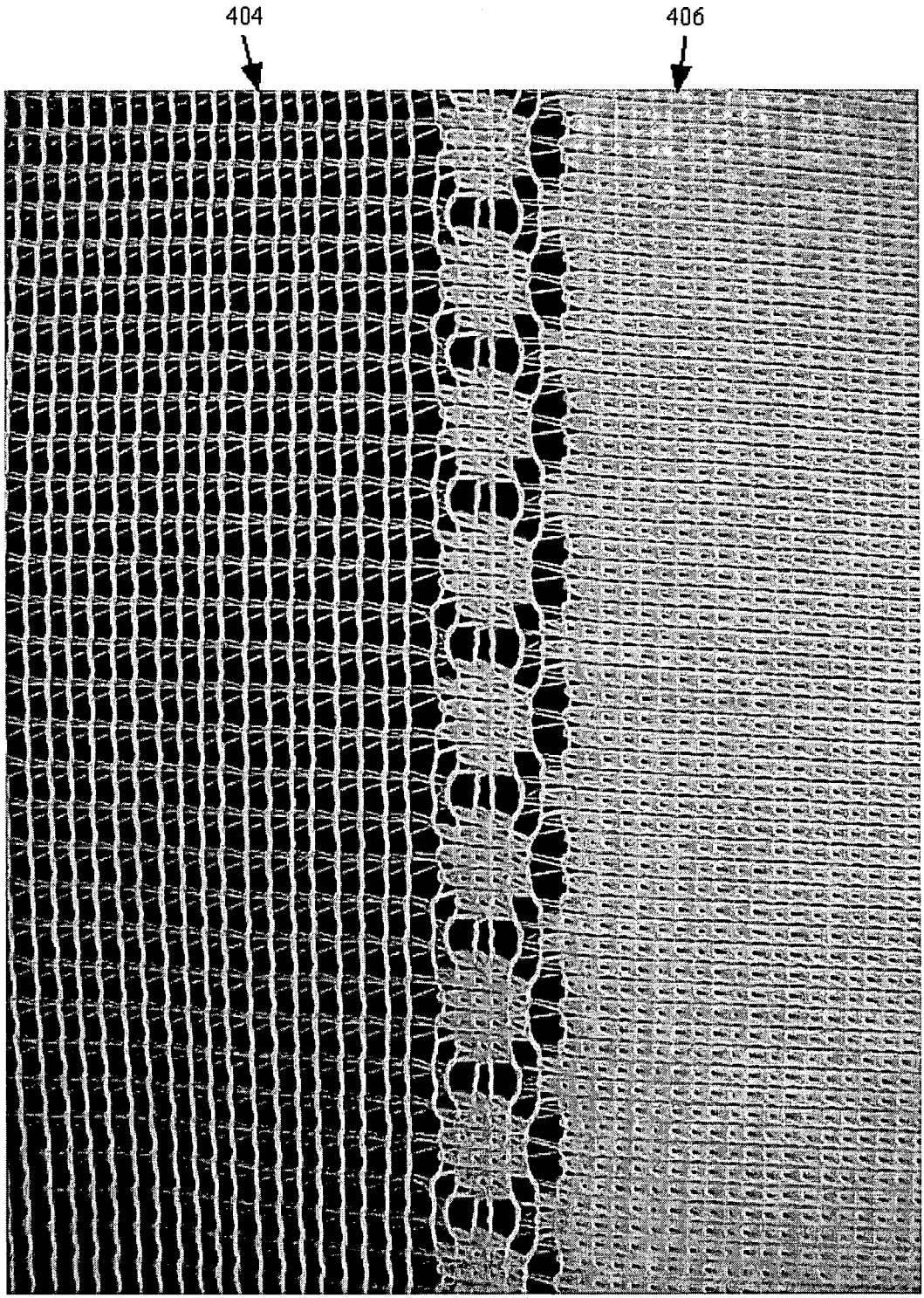
FIG. 19 is a partial plan view showing a transition region between a louver and a spacer in the vertical blind panel of FIG. 17.

As shown in FIG. 18, adjacent louvers 406 and 408 are attached to one another by means of a folding point or hinge 414. The hinge 414 is made up of single pillar stitch 416 that runs between the louvers 406 and 408, and horizontal yarns 418 and 420 that connect the pillar stitch 416 to the edges of the louvers 406 and 408, respectively. The yarns 418 and 420 are suitably soft so that the hinge 414 can easily rotate 180 degrees, allowing the louvers 406 and 408 to be disposed in face to face relation when installed, as explained in further detail below. In contrast to the transition between adjacent louvers 406 and 408, as shown in FIG. 19, the transition between a sheer spacer 404, 410 and a louver 402, 406, 408, 412 does not require a hinge. However, in other embodiments of the invention, a hinge or join point may be disposed between the spacers and louvers.

In the present embodiment of the invention, the top and bottom edges of the panel 400 do not require sewing. In this regard, an ultrasonic cutting device may be used to cut the panel 400 from a continuous web of vertical blind panels, an example of which is shown in FIG. 1. Alternatively, the edges of the panel 400 may be trimmed using an ultrasonic cutting device after the panel 400 is formed. An example of such an ultrasonic cutting device is Model UFF2, 40 kHz Hand Slitter, available from Dukane Corporation of St. Charles, Ill. These ultrasonic cutting devices have the ability to rapidly cut a very straight and clean edge with the added benefit of sealing the cut edge at the same time. This simplifies the manufacturing process and creates a hem-free panel with a very clean look. The sealing permanently binds the cut fibers together so that they will not unravel, which is important for washability and durability.

Figure 20:
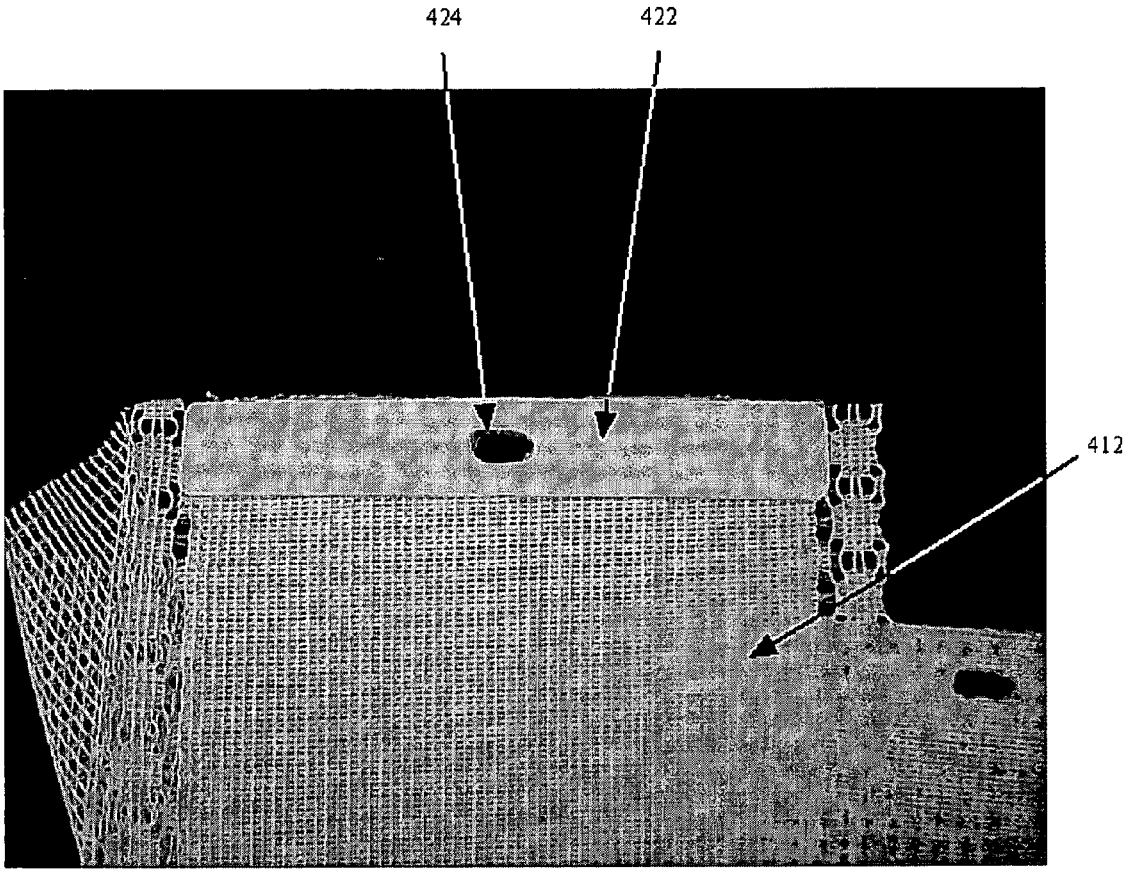
FIG. 20 is a partial plan view of a hanger reinforcement member attached to an upper edge portion of a louver in the vertical blind panel of FIG. 17.

In addition, as shown in FIG. 20, a hanger reinforcement member 422 is attached to the upper edge portion of each of the louvers of the panel 400. The hanger reinforcement member 422 is used to attach the panel 400 to a head rail, and may be made of any suitably rigid material, such as, for example, plastic. The hanger reinforcement member 422 are preferably attached to the louvers by a non-sewing method, such as, for example, ultrasonic welding or adhesive. This eliminates the need for folding and sewing a slot into which a reinforcement is to be inserted. An example of an ultrasonic welding device used to attach the hanger reinforcement member 422 is Model 2220T220PB-L2, Basic 2200W 220 Press, also available from Dukane Corporation. Also, a hole 424 is formed in the reinforcement member 422, which aligns with a hole cut in the corresponding louver, to allow a hook in the head rail to pass through.

Figure 21:
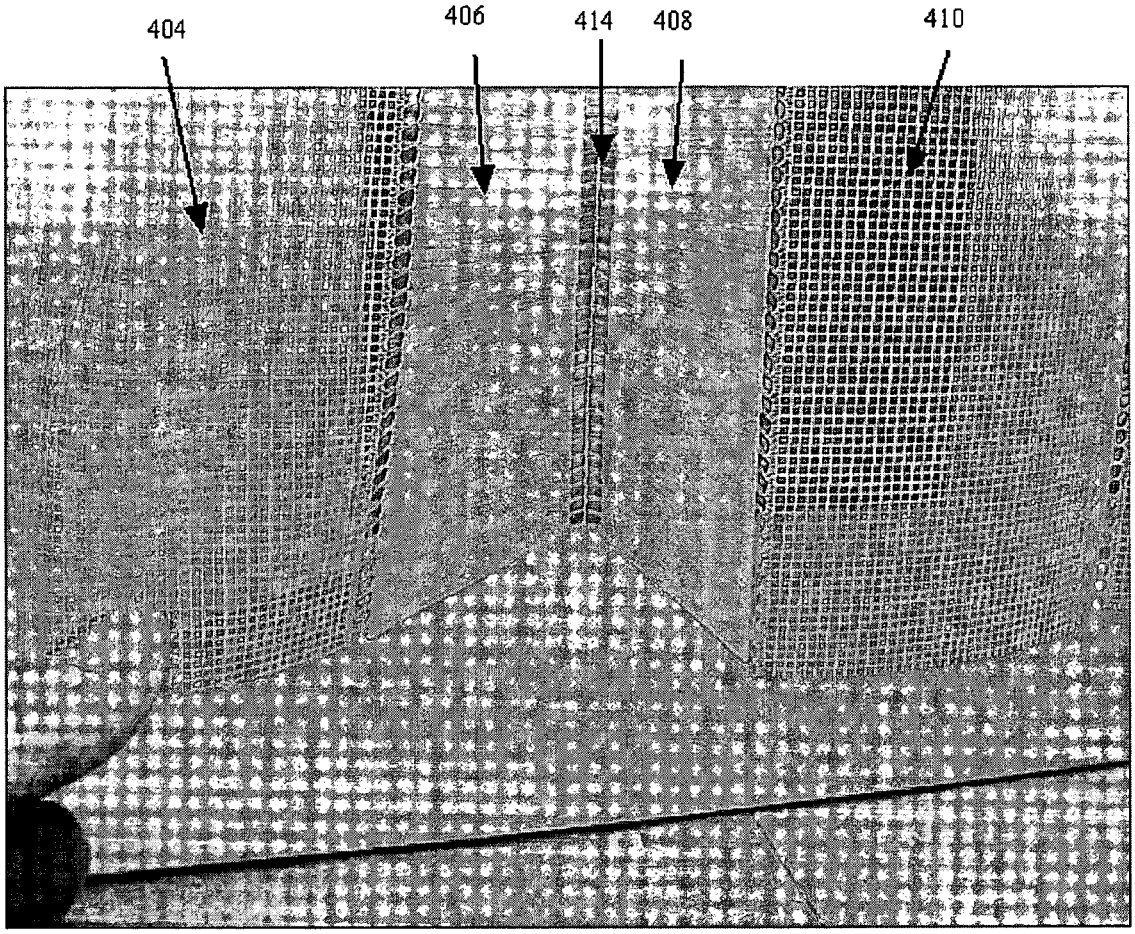
FIG. 21 shows adjacent louvers being folded relative to one another in the vertical blind panel of FIG. 17.

A method of hanging the vertical blind panel 400 to a conventional head rail will now be explained. Beginning at the left side of the head rail, the left-most louver 402 is attached to the left-most hook on the hanger by passing the hook through the hole 424 in the hanger reinforcement member 422 on the top edge of the panel 400. At this point, the louver 402 is disposed perpendicular to the plane of the window, such that the first sheer spacer 404 is disposed towards the front (room-side) of the installation. As shown in FIG. 21, the next two louvers 406, 408 are then folded back to back about the hinge 414 and the next hanger hook is passed through the holes 424 formed in both of these louvers. There will now be two louvers (first louver 402 and another louver formed by the folded combination of the second louver 406 and the third louver 408) hanging with a sheer spacer 404 between them, with the spacer 404 disposed towards the front of the assembly. Hanging continues in this matter until the entire panel 400 is attached. If more louvers are needed, a left-most louver of another panel may be attached to the same hook as the last or right-most louver 412 of the panel 400, and the louvers and spacers of the added panel may be attached to the head rail in the same manner as described above. As many panels may be attached to one another in this manner as needed to form a complete vertical blind assembly across the entire width of a window. Any extra louvers/spacers on the panel left over may be torn away, leaving the panel with a clean edge.

Figure 22:
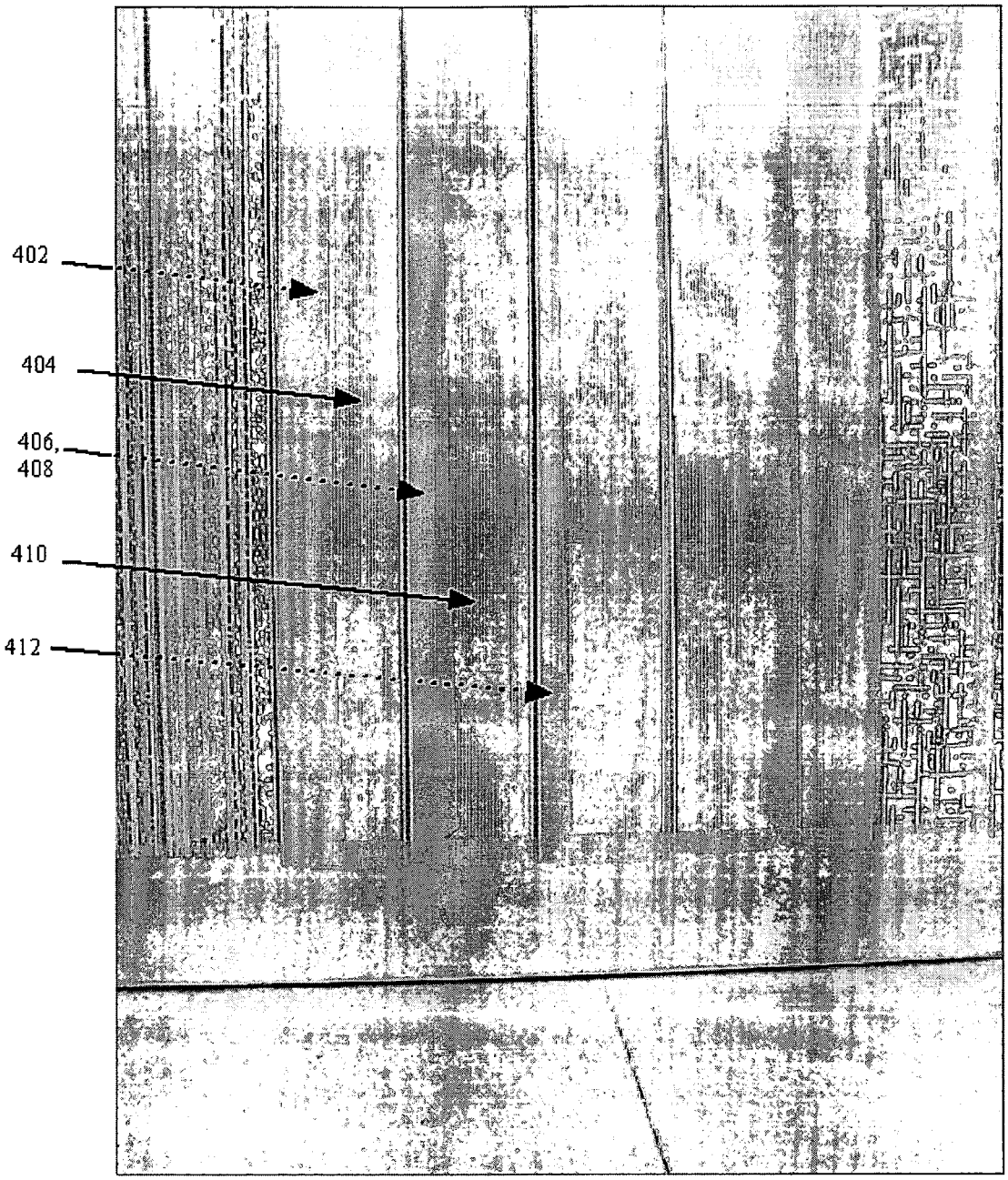
FIG. 22 shows the vertical blind panel of FIG. 17 assembled as a vertical blind in the open configuration.

The vertical blind according to the present embodiment may be manipulated by adjusting the controls on the head rail. Generally, the head rail provides a means for rotating the louvers in unison and for drawing the blind to the side (or sides) of the head rail. There are essentially three main positions for the vertical blind: open, closed and drawn. In the open position, the blind is fully extended along the length of the head rail and the louvers are rotated so that they are perpendicular to the general plane of the blind, as shown in FIG. 22. In this position, the blind lets a majority of light to pass through it, but diffuses the light to some extent, thereby creating a drapery-like appearance. In the closed position, the blind is fully extended along the length of the head rail and the louvers are positioned so that they are parallel to the general plane of the blind. In this position, the blind appears opaque and a maximum amount of privacy is achieved. In the drawn position, the blind is pulled either to one side or, if center split, to either side of the head rail. In this position, the blind is more or less removed from view and the window or door behind is fully visible and accessible.

In some embodiments of the present invention, top and bottom edges of the vertical blind panels are designed to have a folded and sewn hem. In these embodiments, the vertical blind panels are either engineered with fold and sew markings or open ended to be cut to length. Alternatively, the bottom edge of the vertical blind panel can be folded and ultrasonically bonded to form a hem, without requiring sewing.

The machinery used in the manufacture of the above vertical blind embodiment incorporating the frangible connection of the invention, in the most general terms is warp knitting machinery. Warp knitting is best defined as the creation of fabric from individual yarns by forming stitches along the direction of the warp. The stitches and yarns forming those stitches are continuous and run vertically through the fabric in the warp direction. This separates warp knitting from circular knitting, also known as weft knitting, where the stitches and yarns run horizontally through the fabric in the weft direction. Weaving is entirely different as there are no stitches and fabric is formed by interlocking warp yarns running vertically and weft yarns running horizontally in an over/under fashion.

More specifically, jacquard warp knitting machinery is preferably used in the production of the above described blinds. Jacquard warp knitting machinery allow the combination of fabric forming mechanics of warp knitting with pattern forming possibilities of the Jacquard patterning system. As will be obvious to a person of skill in the art, there are many different machine types within this group. Examples of suitable jacquard warp knitting machinery are the Karl Mayer Model RJC 3/2F and the Karl Mayer Model RJCE 4/2F, both of Karl Mayer GmbH, Germany.

The Karl Mayer Model RJC 3/2F is a 3 bar, double jacquard, warp knitting machine. The gauge on this machine is 18 needles per inch, useful for production of "fine gauge" blinds, but it can be set to other gauges. The double jacquard feature offers the flexibility of 2 completely separate patterning mechanisms. One of the jacquard mechanisms is used only for decorative patterning. The other is used for both decorative patterning and the creation of the connectors in the frangible hinges and the tear away fringes disclosed above.

There are 3 separate bars that manipulate yarn for incorporation into the fabric. Two are the jacquard bars as mentioned above. The third is a bar that creates the pillar stitch. Different yarns can be loaded into each of the bar positions to create additional contrasts within the pattern.

Typically, jacquard bar 1 will be loaded with a relatively heavy yarn or a combination of heavy and light yarns, jacquard bar 2 will be loaded with a lighter yarn and the pillar bar, creating the base structure of the fabric, will be loaded with a yarn that meets the mechanical need of the fabric being manufactured.

The Karl Mayer Model RJCE 4/2F is a 4 bar double jacquard, warp knitting machine. The gauge on this machine is 9 needles per inch, useful for production of "coarse gauge" blinds, but it can be set to other gauges. The double jacquard feature offers the flexibility of 2 completely separate patterning mechanisms. One of the jacquard mechanisms is used only for decorative patterning. The other is used for both decorative patterning and the creation of the connectors in the frangible hinges and the tear away fringes.

There are 4 separate bars that manipulate yarn for incorporation into the fabric. Two are the jacquard bars as mentioned above. The third is a bar that creates the pillar stitch. The fourth is a bar that inlays a stabilizing yarn for added rigidity. Different yarns can be loaded into each of the bar positions to create additional contrasts within the pattern.

Typically jacquard bar 1 will be loaded with a relatively heavy yarn or a combination of heavy and light yarns, jacquard bar 2 will be loaded with a lighter yarn and the pillar and stabilizing bars, creating the base structure of the fabric, will be loaded with a yarn that meets the mechanical need of the fabric being manufactured.

Many different combinations of yarns for the manufacture of these blinds are possible, and would be obvious to a person of skill in the art. One yarn combination used on an RJC 3/2F machine is as follows:

Jacquard Bar 1: 300 denier, 68 Filament, Semi Dull, Textured Polyester. This is a heavy yarn used to create bold pattern designs and to impart opacity to the blind louvers.

Jacquard Bar 2: 50 Denier, 24 Filament, Semi Dull, Filament Polyester, Regular Tenacity. This is a lighter yarn used to create some pattern effects as well as the connectors for the frangible hinges and tear away fringes. The critical specification of this yarn is its tensile strength which is lower than the yarns used to create the pillar stitches.

Bar 3: 70 Denier, Semi Dull, Textured Polyester, High Tenacity. This is the yarn used to form the pillar stitches which are the base structure for the fabric. High tenacity yarn is used to increase the strength and assure that the structure of the fabric is not damaged when the louvers are separated.

A second yarn combination, used on a RJCE 4/2F machine, is as follows: Jacquard Bar 1, Top: 150 Denier, 50 Filament Polyester. This is a medium yarn which is used in conjunction with other yarns to create contrasting bold pattern effects and impart opacity to the blind louvers.

Jacquard Bar 1, Bottom: 3 Ply, 150 Denier, 34 Filament Polyester. This is very heavy yarn used in conjunction with the yarn in jacquard bar 1, top above.

Jacquard Bar 2: 70 Denier Polyester, Regular Tenacity. This is a lighter yarn used to create some pattern effects as well as the connectors for the frangible hinges and tear away fringes.

Bar 3: 70 Denier, Semi Dull, Textured Polyester, High Tenacity. This is the yarn used to form the pillar stitches which are the base structure for the fabric. High tenacity yarn is used to increase the strength and to assure that the structure is not damaged when the louvers are separated.

Bar 4: 70 Denier, Semi Dull, Textured Polyester, High Tenacity. This yarn is used as a stabilizer to add rigidity to the fabric.

Yarn tenacity is defined as the maximum load that can be applied to a yarn before breaking, expressed in grams per denier. When comparing polyester yarns of different deniers, the thicker yarn (higher denier) will be stronger. But, since the tenacity is expressed in grams per denier, they may have the same tenacity rating. It is for this reason, for the intent of having one yarn be stronger than another, that tenacity is only important if the two yarns are of relatively the same denier. Below is a comparison of two 70 denier polyester yarns from the same supplier, one regular tenacity and one high tenacity. These data were copied from test results and yarn specifications provided by the yarn manufacturer, Dillon Yarn Corporation of Patterson, N.J. The high tenacity version has a 22.7% increase in tenacity over the regular version.

| ITEM | 1/70/36 Regular Polyester | 1/70/34 High Tenacity Polyester |
|---|---|---|
| Actual Denier | 76.8 | 66.5 |
| Tenacity Grams/Denier | 4.97 | 6.10 |
| Elongation | 24.4% | 17.63% |
| Breaking Strength, Grams | 381.7 | 405.6 |

It will be appreciated from the above noted description of various arrangements of embodiments of the present invention, that a frangible connection in a form of hinge or a tear away fringe has been described which is employed in the production of vertical blinds from single panels of fabric. It will also be appreciated that the features described in connection with each arrangement of the invention are interchangeable to some degree so that many variations beyond those specifically described are possible. For example, fabric panels incorporating components other than those for vertical blinds may also be frangibly connected by the present invention as disclosed herein.

Although the present invention has been described to a certain degree of particularity, it is understood that the present disclosure has been made by way of example, and changes in detail or structure may be made without departing from the spirit of the invention.

What is claimed is:

1. A vertical blind panel comprising:

a seamless and single-layer sheet of material, comprising:

a plurality of substantially opaque louvers; and a plurality of sheer transparent or translucent spacers, each of the plurality of spacers disposed between a respective pair of the plurality of louvers, at least one of the plurality of louvers comprising a vertically oriented first louver and a vertically oriented second louver, each of the first and second louvers having a first vertical edge and a second vertical edge, the first vertical edges of the first and second louvers being directly connected to one another by a frangible hinge, which allows the first and second louvers to fold relative to one another about a hinge point, the second vertical edge of the first louver being directly connected to one of the plurality of spacers, the second vertical edge of the second louver being directly connected to another one of the plurality of spacers, the second vertical edges of the first and second louvers being connected to one another only indirectly via the frangible hinge, the frangible hinge comprising a vertical pillar stitch and connector yarns that attach the first and second louvers to the pillar stitch; and a means for hanging the sheet of material.

2. The vertical blind panel of claim 1, wherein the horizontal edges of the louvers and spacers are cut from a material web by horizontally cutting the material web using an ultrasonic cutting device.

3. The vertical blind panel of claim 1, wherein the means for hanging comprises a hanger reinforcement member formed at an upper edge portion of each of the louvers.

4. The vertical blind panel of claim 3, wherein the hanger reinforcement member is attached to a respective louver by at least one of ultrasonic welding and adhesive.

5. The vertical blind panel of claim 3, wherein the hanger reinforcement member comprises a hole through which a vertical blind hanger hook may pass.

6. The vertical blind panel of claim 1, wherein the plurality of louvers comprise a first end louver that forms a first vertical edge of the vertical blind panel and a second end louver that forms a second vertical edge of the vertical blind panel, and only the louvers between the first and second end louvers comprise first and second louvers.

7. A vertical blind assembly comprising:

at least one vertical blind panel comprising a seamless and single-layer sheet of material, the single-layer sheet comprising:

a plurality of substantially opaque louvers; and a plurality of sheer transparent or translucent spacers, each of the plurality of spacers disposed between a respective pair of the plurality of louvers, at least one of the plurality of louvers comprising a vertically oriented first louver and a vertically oriented second louver, each of the first and second louvers having a first vertical edge and a second vertical edge, the first vertical edges of the first and second louvers being directly connected to one another by a frangible hinge, which allows the first and second louvers to fold relative to one another about a hinge point, the second vertical edge of the first louver being directly connected to one of the plurality of spacers, the second vertical edge of the second louver being directly connected to another one of the plurality of spacers, the second vertical edges of the first and second louvers being connected to one another only indirectly via the frangible hinge, the frangible hinge comprising a vertical pillar stitch and connector yarns that attach the first and second louvers to the pillar stitch;

a hanger reinforcement member formed at an upper edge portion of each of the louvers, the hanger reinforcement member comprising a hole through which a vertical blind hanger hook may pass, wherein the plurality of louvers comprise a first edge louver that forms a first vertical edge of the vertical blind panel and a second edge louver that forms a second vertical edge of the vertical blind panel, and only the louvers between the first and second edge louvers comprise first and second louvers, and the at least one vertical blind panel comprises a plurality of vertical blind panels, and each vertical blind panel is connected to an adjacent vertical blind panel by passing a hanger hook through adjacent first and second edge louvers.

8. The vertical blind assembly of claim 7, wherein the horizontal edges of the louvers and spacers are cut from a material web by horizontally cutting the material web using an ultrasonic cutting device.

9. The vertical blind assembly of claim 7, wherein the hanger reinforcement member is attached to a respective louver by at least one of ultrasonic welding and adhesive.

10. A method of forming vertical blind panels, comprising:

forming a continuous web of seamless and single-layer vertical blind panels, each of the vertical blind panels comprising:

a plurality of substantially opaque louvers; and a plurality of sheer transparent or translucent spacers, each of the plurality of spacers disposed between a respective pair of the plurality of louvers, at least one of the plurality of louvers comprising a first vertically oriented louver portion and a second vertically oriented louver portion, each of the first and second louver portions having a first vertical edge and a second vertical edge, the first vertical edges of the first and second louver portions being directly connected to one another by a frangible hinge, which allows the first and second louver portions to fold relative to one another about a hinge point, the second vertical edge of the first louver portion being directly connected to one of the plurality of spacers, the second vertical edge of the second louver portion being directly connected to another one of the plurality of spacers, the second vertical edges of the first and second louver portions being connected to one another only indirectly via the frangible hinge, the frangible hinge comprising a vertical pillar stitch and connector yarns that attach the first and second louvers to the pillar stitch;

cutting the continuous web of vertical blind panels to form separate vertical blind panels; and attaching a means for hanging the separated vertical blind panels to at least one of the separated vertical blind panels.

11. The method of claim 10, wherein the cutting step comprises cutting the continuous web of vertical blind panels horizontally using an ultrasonic cutter to form horizontal edges of the separate vertical blind panels.

12. The method of claim 10, wherein the means for hanging comprises a hanger reinforcement member at an upper edge portion of each of the louvers.

13. The method of claim 12, wherein the hanger reinforcement member is attached to a respective louver by at least one of ultrasonic welding and adhesive.

14. The method of claim 10, wherein the plurality of louvers comprise a first louver that forms a first vertical edge of the vertical blind panel and a second louver that forms a second vertical edge of the vertical blind panel, and only the louvers between the first and second louvers comprise first and second louver portions.

* * * * *